US011362444B2

(12) United States Patent
Schneider

(10) Patent No.: US 11,362,444 B2
(45) Date of Patent: Jun. 14, 2022

(54) LAMINATED WIRE CONNECTOR

(71) Applicant: Interplex Industries, Inc., East Providence, RI (US)

(72) Inventor: Richard Schneider, Livonia, MI (US)

(73) Assignee: Interplex Industries, Inc., East Providence, RI (US)

( * ) Notice: Subject to any disclaimer, the term of this patent is extended or adjusted under 35 U.S.C. 154(b) by 0 days.

(21) Appl. No.: 17/254,282

(22) PCT Filed: Jun. 26, 2019

(86) PCT No.: PCT/US2019/039141
§ 371 (c)(1),
(2) Date: Dec. 20, 2020

(87) PCT Pub. No.: WO2020/006023
PCT Pub. Date: Jan. 2, 2020

(65) Prior Publication Data

US 2021/0184375 A1 Jun. 17, 2021

Related U.S. Application Data

(60) Provisional application No. 62/803,203, filed on Feb. 8, 2019, provisional application No. 62/690,408, filed on Jun. 27, 2018.

(51) Int. Cl.
*H01R 4/24* (2018.01)
*H01R 4/2429* (2018.01)
(Continued)

(52) U.S. Cl.
CPC ..... *H01R 4/2429* (2013.01); *H01R 4/2425* (2013.01); *H01R 9/226* (2013.01); *H01R 12/585* (2013.01); *H01R 13/41* (2013.01)

(58) Field of Classification Search
None
See application file for complete search history.

(56) References Cited

U.S. PATENT DOCUMENTS 4,527,852 A 7/1985 Dechelette
4,577,922 A 3/1986 Stipanuk
(Continued)

FOREIGN PATENT DOCUMENTS

DE 102013013458 B3 10/2014
EP 1531522 A1 5/2005
(Continued)

OTHER PUBLICATIONS

International Search Report for PCT/US2019/039141, dated Sep. 25, 2019.
(Continued)

*Primary Examiner* — Ross N Gushi
(74) *Attorney, Agent, or Firm* — Katterle Nupp LLC; Paul Katterle; Robert Nupp

(57) ABSTRACT

An electrical connector and associated terminal are disclosed for making an electrical connection to a wire. The terminal includes a plurality of metal plates adjoining each other to form a stack that defines a passage for receiving the wire. The plates include a plurality of cutter plates disposed between a pair of outer holding plates. Each of the cutter plates has a pair of cutting edges for disrupting any insulation on the wire to permit a conductor of the wire to directly contact the cutter plate. One or more of the cutter plates may have a contact projection for making an electrical connection. The connector includes the terminal and may further include a housing. The holding plates of the terminal have outer edges with abutment features for engaging interior surfaces of the housing.

21 Claims, 42 Drawing Sheets

(51) Int. Cl.

| | |
|---|---|
| ***H01R 12/58*** | (2011.01) |
| ***H01R 13/41*** | (2006.01) |
| ***H01R 9/22*** | (2006.01) |
| ***H01R 4/2425*** | (2018.01) |

(56) References Cited

U.S. PATENT DOCUMENTS

| | | | |
|---|---|---|---|
| 5,030,132 | A | 7/1991 | Hayes |
| 5,052,953 | A | 10/1991 | Weber |
| 5,685,733 | A | 11/1997 | Janczak |
| 5,997,336 | A | 12/1999 | Yamamoto |
| 6,050,842 | A | 4/2000 | Ferrill |
| 6,974,329 | B2 | 12/2005 | Henneberg |
| 8,197,289 | B1 | 6/2012 | Faber |
| 8,708,733 | B2 | 4/2014 | Parrish |
| 9,431,721 | B2 | 8/2016 | Wimmer |
| 9,590,323 | B2 | 3/2017 | Winheim |
| 9,666,962 | B1 | 5/2017 | Bucher |
| 9,899,754 | B2 | 2/2018 | Winheim |
| 10,522,945 | B2 | 12/2019 | Schneider |
| 10,763,607 | B2 | 9/2020 | Schneider |
| 10,784,623 | B2 | 9/2020 | Schneider |

FOREIGN PATENT DOCUMENTS

| | | | |
|---|---|---|---|
| WO | WO2013039657 | A2 | 3/2013 |
| WO | WO2018039123 | A1 | 3/2018 |

OTHER PUBLICATIONS

Written Opinion of the ISA for PCT/US2019/039141, dated Jan. 2, 2020.

LAMINATED WIRE CONNECTOR

CROSS-REFERENCE TO RELATED APPLICATION(S)

This application is the U.S. national phase of PCT Application No. PCT/US2019/039141 filed on 26 Jun. 2019, which claims the benefit of priority under 35 U.S.C. § 119(e) to U.S. Provisional Patent Application No. 62/690,408, filed on Jun. 27, 2018, and to U.S. Provisional Patent Application No. 62/803,203, filed on Feb. 8, 2019, all of the foregoing patent applications being herein incorporated by reference.

TECHNICAL FIELD

The present disclosure relates to a connector for use in making an electrical connection to wire, more particularly to an insulation displacement connector (IDC) having an insulation displacement terminal (IDT).

BACKGROUND

An IDC with an IDT is used to quickly make an electrical connection to an insulated wire. The IDC often includes a housing, inside of which the IDT makes the electrical connection to the wire. Conventionally, an IDT has spaced-apart legs for disposal and movement over an insulated wire to displace or remove its outer coating or cover so as to expose and make contact with the metal conductor underneath.

Typically, an IDC and its associated IDT are constructed for use with narrow gauge wire. Electrical connections for larger gauge wire are typically made by welding or bolted crimps. However, welding is not aesthetically pleasing and is often difficult, if not impossible, in applications with space constraints. Crimped lugs are also not suitable for applications with space constraints. Moreover, crimped lugs are typically expensive. Accordingly, there is a need for IDCs for use with larger gauge wire.

SUMMARY

In accordance with the disclosure, an insulation displacement connector is provided for making an electrical connection to at least one wire having an inner metal conductor covered with an outer insulation layer. The insulation displacement connector includes a plurality of metal plates secured together to form a stack that defines a passage for receiving the wire. At least one of the plates has a cutting edge for disrupting the insulation layer of the wire to permit the conductor to directly contact the plate.

The insulation displacement connector may further include a housing having a pair of opposing side walls with slots formed therein and an interior pocket accessible through an exterior opening in the housing. The pocket is adapted to receive at least a portion of the stack of the metal plates and is at least partially defined by opposing interior surfaces. The slots are aligned and cooperate with the pocket to form a route extending through the housing. The route is adapted to receive the wire and is aligned with the passage in the stack when the stack is disposed in the pocket.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
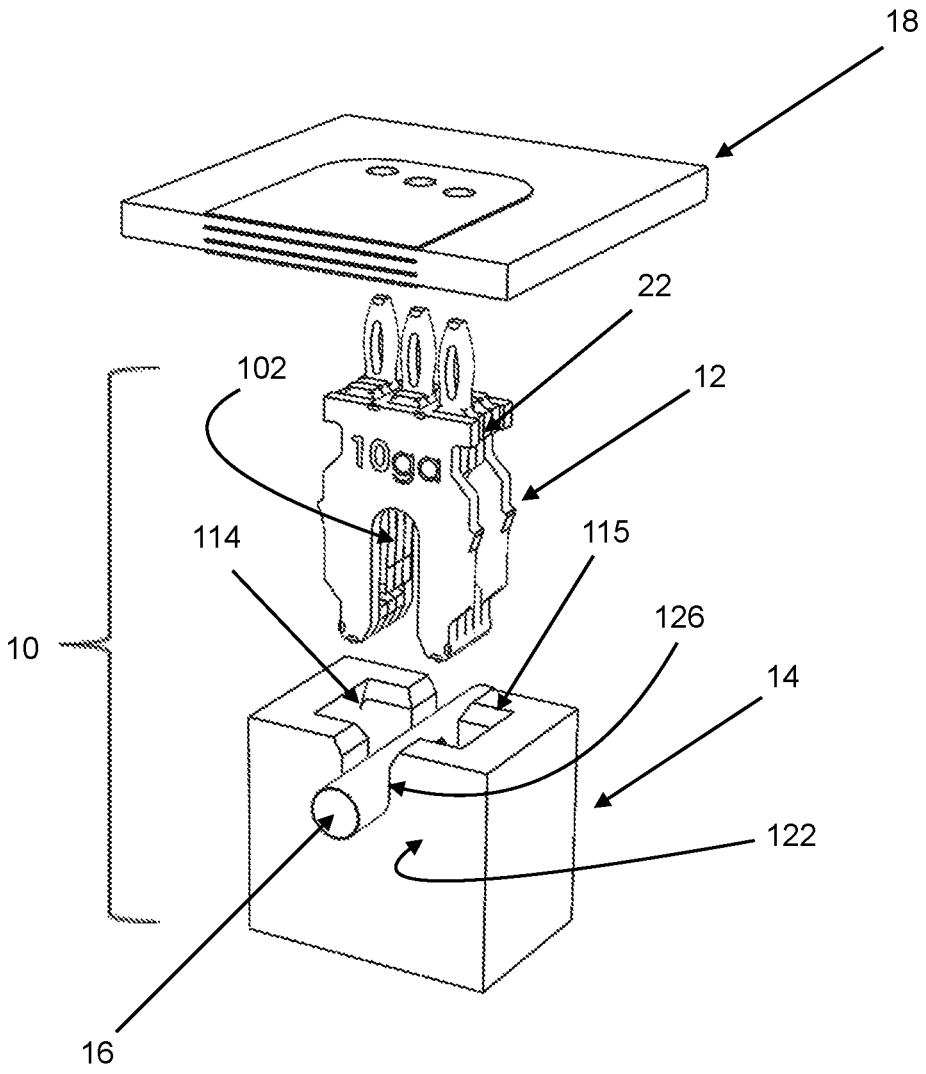
FIG. 1 shows a partially exploded perspective view of an insulation displacement connector (IDC) having an insulation displacement terminal (IDT) constructed in accordance with a first embodiment.

It should be noted that in the detailed descriptions that follow, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Spatially relative terms, such as "top", "bottom", "lower", "above", "upper", and the like, are used herein merely for ease of description to describe one element or feature's relationship to another element(s) or feature(s) as they are illustrated in (a) drawing figure(s) being referred to. It will be understood that the spatially relative terms are not meant to be limiting and are intended to encompass different orientations of the device in use or operation in addition to the orientation depicted in the drawings.

Referring now to FIG. 1, there is shown a partially exploded view of an insulation displacement connector (IDC) 10 that includes a laminated insulation displacement terminal (IDT) 12. The IDC 10 may further include a housing 14. The IDC 10 is operable to electrically connect an insulated wire 16 to an electrical/electronic device, such as a printed circuit board (PCB) 18. The wire 16 may have a conventional construction with an inner metal conductor covered with an outer insulation layer, which may be a coating or sheath composed of an insulating polymeric material. The wire 16 may have a diameter of 10 gauge or greater. While the IDC 10 is especially adapted for use with larger gauge wire, its use is not limited to larger gauge wire and may be used with any gauge wire. Also, while the IDT 12 is typically used with a housing (such as the housing 14) or a mounting bracket, the IDT 12 may be used alone to connect a wire to another electrical conductor. In such a situation, the IDT 12 alone forms the IDC 10.

Figure 2:
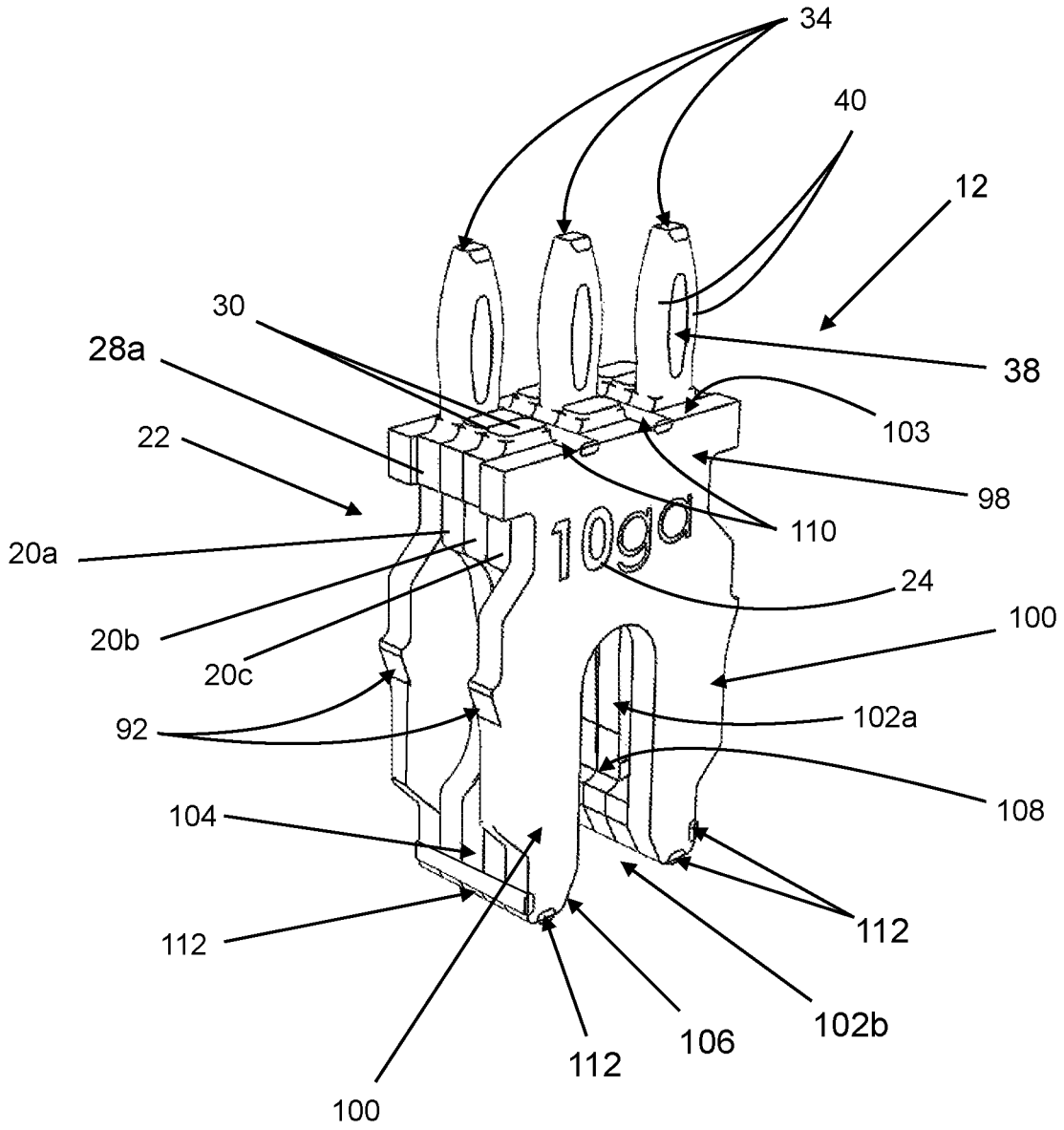
FIG. 2 shows a perspective view of the IDT shown in FIG. 1.
Figure 3:
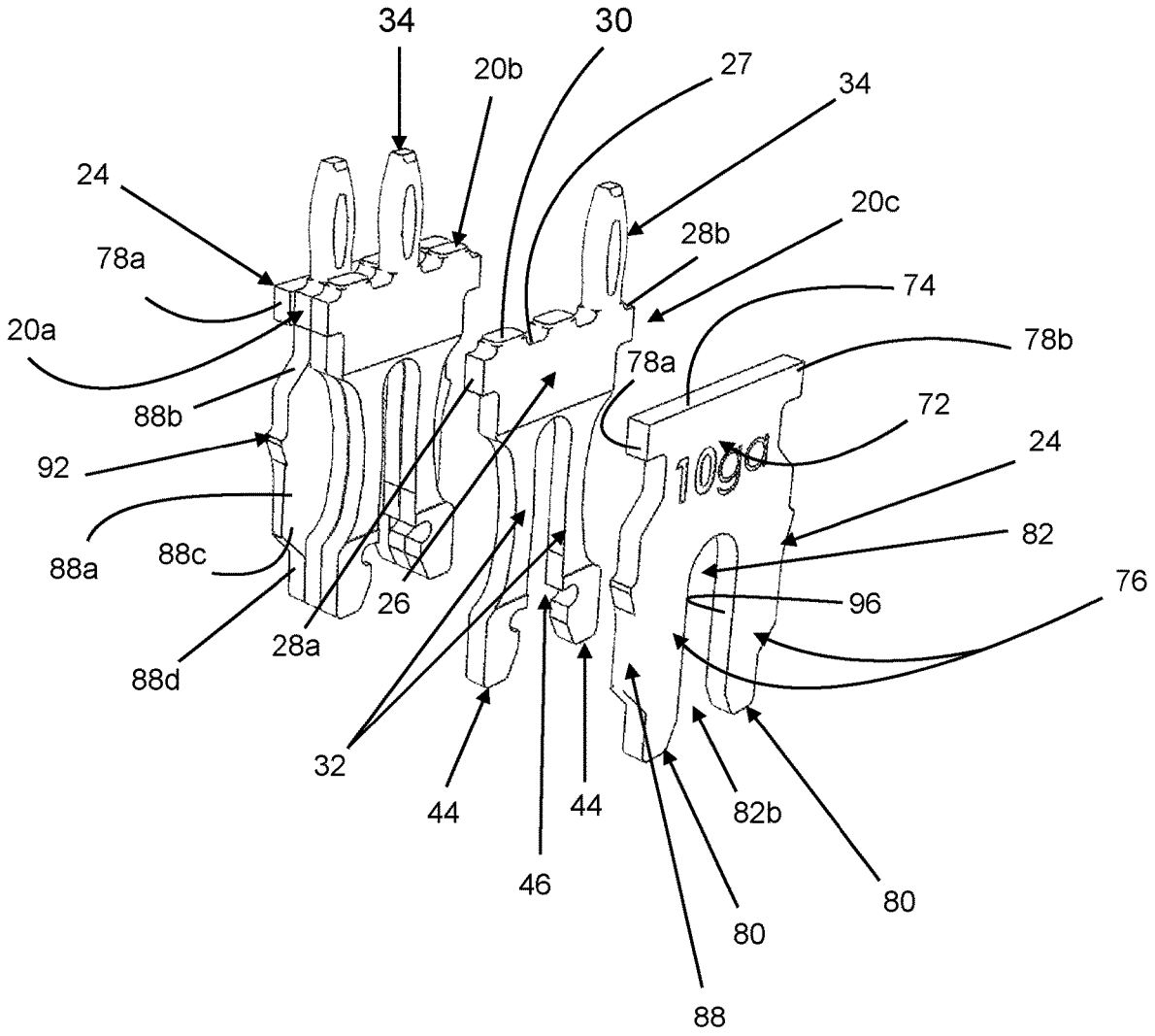
FIG. 3 shows a partially exploded perspective view of the IDT shown in FIGS. 1 and 2.
Figure 4:
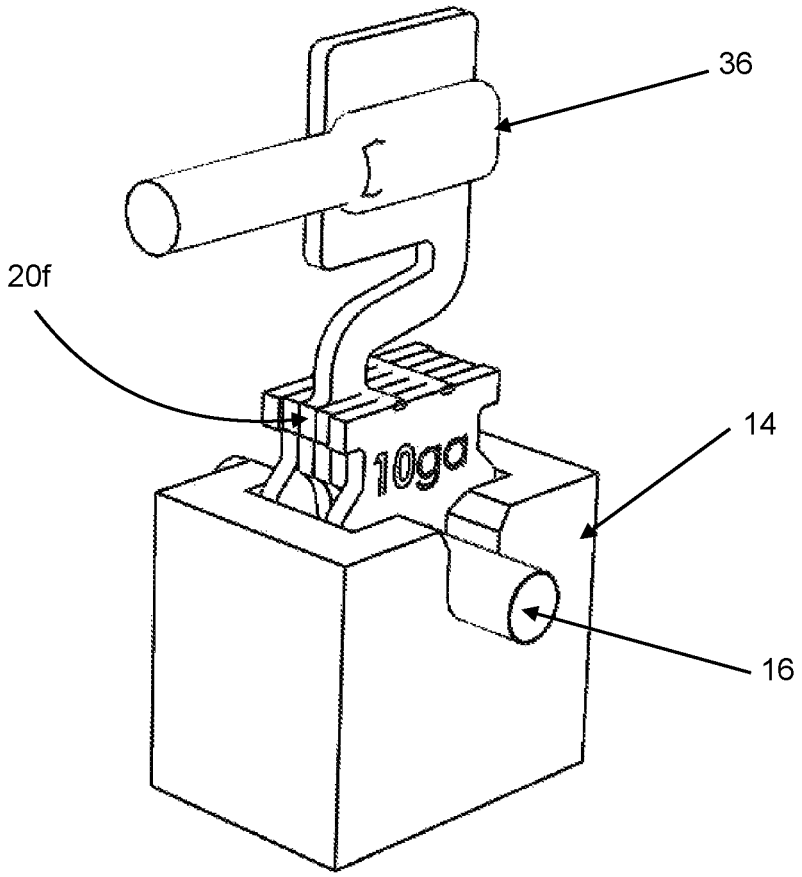
FIG. 4 shows a perspective view of an IDT constructed in accordance with a second embodiment.

With reference now also to FIGS. 2 and 3, the IDT 12 include a plurality of plates arranged in a stack 22. The plates include a plurality of cutter plates 20 disposed between outer holding plates 24. The plates 20, 24 may directly contact each other or be separated by a thin dielectric layer. Each cutter plate 20 has a monolithic unitary structure and is composed of electrically conductive metal, such as a copper alloy, which may or may not be plated with tin. The cutter plates 20 may, by way of non-limiting example, be formed by stamping. Each cutter plate 20 includes a base 26 having outwardly-extending first and second shoulders 28*a,b*. An upper edge 27 extends between and across the first and second shoulders 28*a,b*. A plurality of spaced-apart mounts 30 may be joined to the upper edge 27, between the first and second shoulders. A pair of engagement legs 32 extend from the base 26 in a first direction, while one or more contact projections may extend from the base 26 in a second direction, which is opposite the first direction. Each contact projection is adapted for making electrical connection with an electrical/electronic device. By way of non-limiting example, the contact projection may be a press-fit contact projection 34 (as shown in FIGS. 1-3, 5, 9) for securement within a metal-plated hole of the PCB 18. More specifically, the contact projection 34 may have an eye-of-the-needle construction with a piercing 38 forming a pair of resiliently deflectable beams 40 for engaging the plated wall of defining a hole of PCB. Alternately, the contact projection may be a pin for soldering in a hole of a PCB, or a weld tab 36, as shown in FIG. 4, or may have some other type of construction, as described below.

In those embodiments where each cutter plate 20 has only one contact projection, (such as a pin or contact projection 34), the location of the contact projection may be the same in each of the cutter plates 20. For example, in each of the cutter plates 20, the contact projection may be integrally joined to and extend from a center one of the mounts 30 of the base 26. In this manner, when the cutter plates 20 are arranged in the stack 22, the contact projections will be aligned to form a row in the stacking direction of the cutter plates 20, between the outer plates 24. Alternately, the contact projection may have a different location in each of the cutter plates 20. For example, in the embodiment shown in FIGS. 1-3, the IDT 12 has three cutter plates 20*a*, 20*b*, 20*c*, with the contact projection being in a different location in each one. In the cutter plate 20*a*, the contact projection 34 is integrally joined to and extends from a first outer one of the mounts 30, located toward the first shoulder 28*a*, whereas in the cutter plate 20*b*, the contact projection 34 is integrally joined to and extends from the center one of the mounts 30, and in the cutter plate 20*c*, the contact projection 34 is integrally joined to and extends from a second outer one of the mounts 30, located toward the second shoulder 28*b*. In this manner, when the cutter plates 20 are arranged in the stack 22, the contact projections form a row that extends diagonally across the IDT 12, i.e., extends both in the stacking direction, between the holding plates 24, and in the lateral direction, between the first and second shoulders 28*a,b* of the cutter plates 20.

Figure 5:
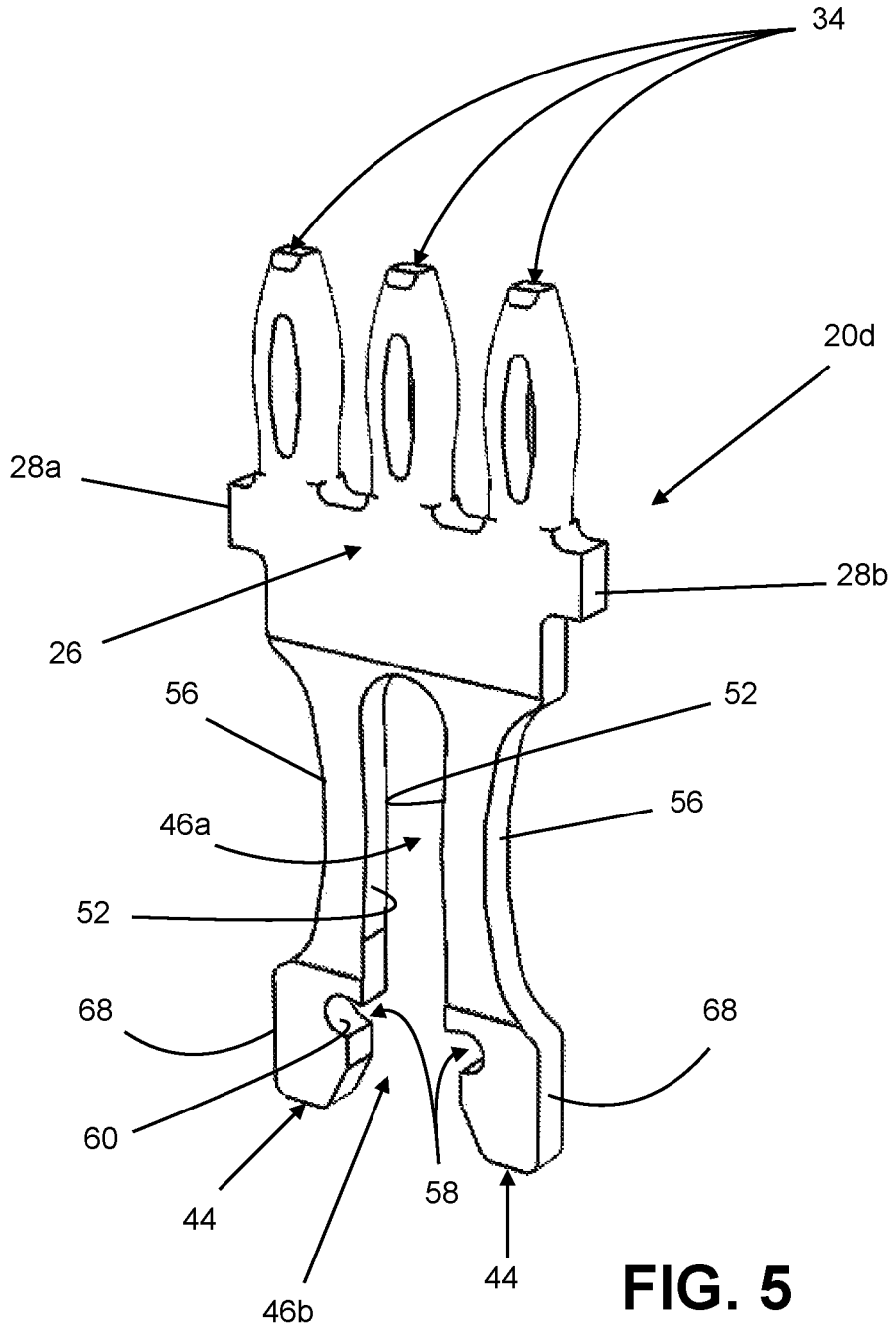
FIG. 5 shows a perspective view of a cutter plate having three contact projections.

Referring now to FIG. 5, there is shown an embodiment, wherein a cutter plate 20*d* has three contact projections 34 integrally joined to and extending from the mounts 30, respectively. In this embodiment, the contact projections 34 are aligned to form a row that extends in the lateral direction, between the first and second shoulders 28*a,b* of the cutter plate 20*d*. Although not shown, a cutter plate 20 may be provided having two contact projections (such as a pin or contact projection 34), which may be integrally joined to the center one of the mounts 30 and a mount 30 adjacent thereto, respectively, or may be integrally joined to the first and second outer ones of the mounts 30, respectively. In addition, a cutter plate 20 may have no contact projections 34 at all, such as the cutter plate 20*e* shown in FIG. 4. Still further, a cutter plate 20 may be provided having more than three mounts 30 and more than three contact projections 34, depending on the application of the IDT 12.

It should be appreciated that the number of cutter plates 20 used in an IDT 12 may be varied, depending on the requirements for a particular application. The number may be determined by the amount of electrical current the IDT 12 is designed to handle, with the current carrying capacity of the IDT 12 being increased by increasing the number cutter plates 20 that are used. As such, an IDT 12 may have greater or less than the three cutter plates 20 shown in FIGS. 1-3. In addition, different arrangements of different cutter plates 20 may be utilized, depending on the need. For example, one cutter plate 20*d* (with three contact projections) may be centrally disposed between two cutter plates 20*e* having no contact projections. In another example, one cutter plate 20*d* may be centrally disposed between two stacks of cutter plates 20*b*. In this example, the contact projections of the IDT 12 would form a row extending in the stacking direction and an intersecting row extending in the lateral direction, thereby forming a cross. In still another example, shown in FIG. 4, an IDT 12*a* has a cutter plate 20*f* with the weld tab 36 centrally disposed between cutter plates 20*e* having no contact projections.

As best shown in FIGS. 3 and 5, each engagement leg 32 of a cutter plate 20 has an upper portion joined to the base 26 and a lower portion forming a free end 44. The engagement legs 32 are spaced-apart to form a slot 46 therebetween. The slot 46 has an arcuate, closed end, located toward the base 26, and an open end, located at the free ends 44. A holding portion 46*a* of the slot 46 is defined by opposing first inner side surfaces 52 of the engagement legs 32, respectively. The first inner side surfaces 52 have a slight convex curvature such that the holding portion 46*a* is most narrow at a point about midway along the length of the holding portion 46*a*. The engagement legs 32 have first outer side surfaces 56 located opposite the first inner side surfaces 52, respectively. The first outer side surfaces 56 are concave. In this manner, the engagement legs 32 are narrowest at the point where the holding portion 46*a* of the slot 46 is narrowest. The foregoing construction of the engagement legs 32 makes them elastic, but with a high degree stiffness, which enables the engagement legs 32 to store enough force to maintain an acceptable contact force on the conductor of the wire 16 disposed in the holding portion 46*a*, even when the cross-section of the conductor of the wire 46 decreases due to mechanical creep. In other words, the engagement legs 32 function as springs to generate a high normal force connection to the conductor of the wire 16.

Figure 6:
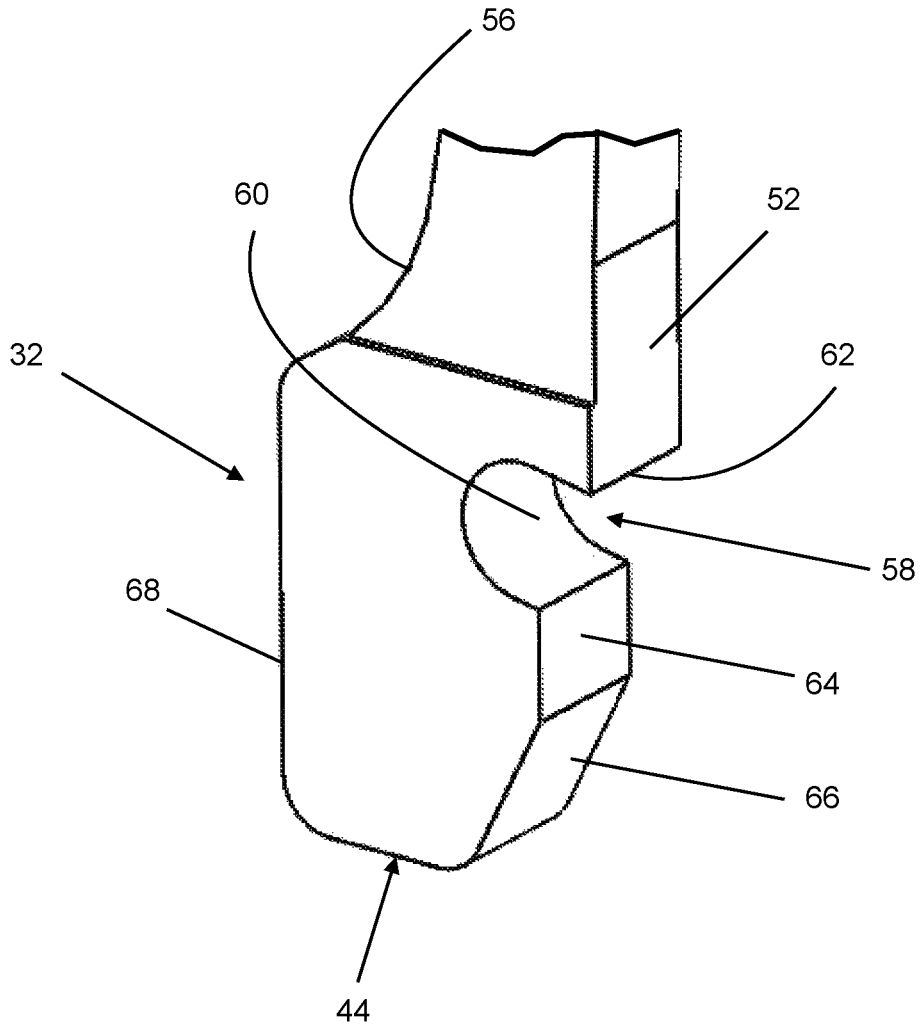
FIG. 6 shows a perspective view of a bottom portion of a leg of a cutter plate.

With particular reference now to FIG. 6, notches 58 are formed in the engagement legs 32, toward the free ends 44, respectively. The notches 58 are arcuate and are defined by curved inner surfaces 60, respectively, which adjoin the first inner side surfaces 52 at sharp corner edges 62, respectively. The sharp edges 62 extend in the direction of the thickness of the cutter plate 20 and function as scrapers and/or cutters for piercing the insulation layer of the wire 16 and are hereinafter referred to as cutters 62. Below the notches 58, the engagement legs 32 each have second and third inner side surfaces 64, 66 and a second outer side surface 68. The second inner side surfaces 64 are substantially straight and are located outward from the first inner side surfaces 52, respectively. The third inner side surfaces 66 slope outward from the second inner side surfaces 64 to the free ends 44, respectively. The second and third inner side surfaces 64,66 define an entrance portion 46*b* of the slot 46. The width of the entrance portion 46*b* is greatest at the free ends 44 and then, as the slot 46 continues toward the base 26, continuously decreases until it reaches the space between opposing second inner side surfaces 64, at which point, the width remains constant until the notch 58 is reached.

Referring back to FIGS. 2, 3 and as described above, the cutter plates 20 are disposed between the holding plates 24, which have a construction generally similar to the cutter plates 20. Unlike the cutter plates 20, however, the holding plates 24 do not have any cutters or scrapers for removing the insulation layer from the wire 16. In addition, the holding plates 24 are typically thicker than the cutter plates 20. The holding plates 24 each have a monolithic unitary structure and are composed of electrically conductive metal, such as a copper alloy, which may or may not be plated with tin. The holding plates 24 may, by way of non-limiting example, be formed by stamping. Each holding plate 24 includes a base 72 having a smooth, planar upper edge 74 extending, uninterrupted, between and across first and second shoulders 7*a,b*. A pair of legs 76 extend from the base 72 in a first (downward) direction. In some embodiments (discussed later), one or more contact projections may extend from the upper edge 74 of the base 72 in a second direction, which is opposite the first direction.

Each leg 76 of the holding plates 24 has an upper portion joined to the base 72 and a lower portion forming a free end 80. The legs 76 are spaced-apart to form a slot 82 therebetween. The slot 82 has an arcuate, closed end, located toward the base 72, and an open end 82*b*, located at the free ends 80. The legs 76 each have an angular outer side surface 88 with a main portion 88*a* disposed between a first sloping portion 88*b* and a second sloping portion 88*c*, which slopes inward to a lower portion 88*d*. Barbs 92 protrude from the main portions 88*a*, respectively. As will be described more fully below, the barbs 92 are resiliently deformable to engage interior surfaces of the housing 14. Upper portions of inner side surfaces 96 of the legs 76 are straight and define a main portion of the slot 82, which has a uniform width, except at the closed end. The width of the main portion of the slot 82 in each holding plate 24 is the same as the width between the second inner side surfaces 64 of the cutter plates 20. Lower portions of the inner side surfaces 96 slope outward to define an enlarged entrance portion 82*b* of the slot 82, which has a width greater than the width of the main portion of the slot 82.

The holding plates 24 have a more rigid construction than the cutter plates 20. For example, the outer side surfaces 88 of the legs 76 are not concave and, thus, are not resiliently deflectable. Moreover, as described above, the holding plates 24 are typically thicker than the cutter plates 20. Accordingly, the the holding plates 24 are more rigid than the cutter plates 20 in a lateral direction, i.e., in a direction normal to the direction of the passage 102 formed by the cutter plates 20 and the holding plates 24 (described below).

The cutter plates 20 and the holding plates 24 are arranged in the stack 22 so as to provide the IDT 12 with a base 98 (which is formed by the bases 26, 72 of the cutter plates 20 and the holding plates 24) and a pair of legs 100 (which are formed by the engagement legs 32 of the cutter plates 20 and the legs 76 of the holding plates 24). Each leg 100 has an outer boundary delimited by the outer side surfaces 88 of the holding plates 24 and an inner boundary delimited by the first and second inner side surfaces 52, 64 of the engagement legs 32 of the cutter plates 20.

The legs 100 of the IDT 12 are separated by a passage 102 that is formed by the slots 46 in the cutter plates 20 and the slots 82 in the holding plates 24. The holding portions 46*a* of the cutter plates 20 are aligned with each other to form a holding portion 102*a* of the passage 102, which is disposed inward from the upper portions of the inner side surfaces 96 of each of the holding plates 24. The second inner side surfaces 64 of the cutter plates 20, however, are aligned with the upper portions of the first inner side surfaces 96 of the holding plates 24, and the third inner side surfaces 66 of the cutter plates 20 are aligned with the lower portions of the inner side surfaces 96 of the holding plates 24. In this manner, the slots 82 in the holding plates 24 are aligned with the entrance portions of the slots 46 in the cutter plates 20 and provide the passage 102 of the IDT 12 with an entrance portion 102*b*. At the juncture between the entrance portion 102*b* and the holding portion 102*a* of the passage 102, the cutters 62 in each of the legs 100 are aligned to form a laminated cutting edge 108.

In the base 98 of the IDT 12, the upper edges 27 of the cutter plates 20 are aligned with each other and with the upper edges 74 of the holding plates 24 to provide the base of the IDT 12 with an upper surface 103. In each leg 100 of the IDT 12, the second outer side surfaces 68 of the cutter plates 20 are aligned with each other and with the lower portions 88*d* of the outer side surfaces 88 of the holding plates 24 to provide the leg 100 with a lower outer side surface 104. In addition, in each leg 100 of the IDT 12, the free ends 44 of the of the cutter plates 20 are aligned with each other and with the free ends 80 of the holding plates 24 to provide the leg 100 with a free end 106.

The plates 20, 24 may be secured together by mechanical means and/or by welding. The plates 20, 24 may be mechanically held together by a bracket or a band in a press-fit manner. For example, a metal band may tightly extend around the IDT 12, just below the base 98. The plates 20, 24 are shown in FIG. 2 being secured together in the stack 22 by electron beam welding or laser beam welding. Welds may be made in a plurality of locations. There may be at least one weld at the top of the base of the IDT 12 and at least one weld in each leg 100 of the IDT 12. As shown, a pair of upper welds 110 may be made across the upper surface 103 of the base 98 of the IDT 12, with each upper weld 110 extending between aligned rows of the mounts 30. Also as shown, a pair of lower welds 112 may be formed in each leg 100 of the IDT 12, with one lower weld 112 extending across the lower outer side surface 104 of the leg 100 and the other lower weld 112 extending across the free end 106 of the leg 100. In forming the welds 110,112, filler metal in the form of wire or powder may be added to control the shape and size of the weld. For example, each weld 110, 112 may be provided with a crown (convex surface of the weld).

Figure 7:
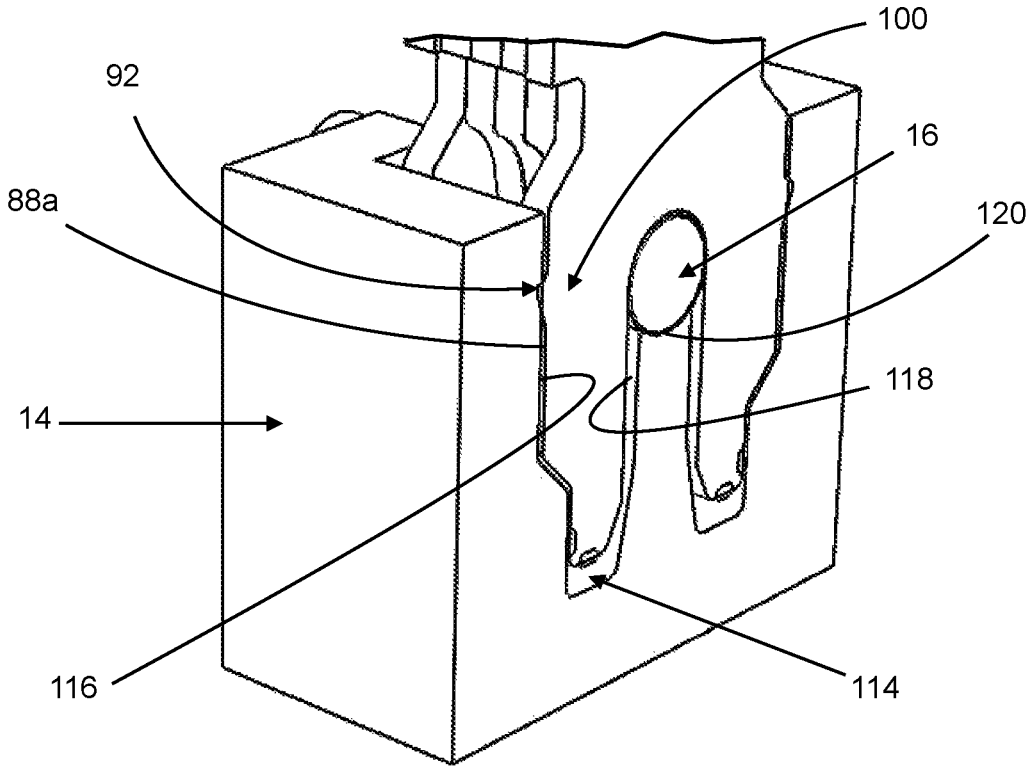
FIG. 7 shows a perspective view of a portion of an IDT mounted inside a housing of an IDC, with a part of the housing cut away to show the interior thereof.

Referring back to FIG. 1 and now also to FIG. 7, the housing 14 is configured for use with the IDT 12. The housing 14 may be formed of plastic and may have a cuboidal shape. The housing 14 may be secured to a second electrical/electronic device, such as a PCB, and, as such, may include features for mounting the housing 14 to the second electrical/electronic device. The housing 14 has an interior pocket 114 with a shape that corresponds to the shape of the IDT 12. The pocket 114 is accessible through an exterior opening 115 in the housing 14. The pocket 114 is formed by a plurality of interior surfaces, including a pair of opposing dogleg-shaped interior side surfaces 116 that correspond to the outer boundaries of the legs 100 and a pair of interior center surfaces 118 that correspond to the inner boundaries of the legs 100, respectively. The interior center surfaces 118 are connected by an abutment surface 120 that extends between and through opposing walls 122 of the housing 14. The abutment surface 120 forms the closed ends of slots 126 that are formed in the walls 122 of the housing 14, respectively, and extend into the pocket 114. The slots 126 cooperate with the pocket 114 to form a route through the housing 14.

The wire 16 extends through the route in the housing 14 and rests against the abutment surface 120, thereby extending across and through the pocket 114, as shown. With the wire 16 so positioned, the IDT 12 is disposed over the opening 115, with the legs 100 disposed toward and aligned with the opening 115 and the passage 102 aligned over the wire 16. The IDT 12 is then pressed down into the pocket 114. As the IDT 12 moves into the pocket 114, the wire 16 (relatively speaking) enters and moves through the entrance portion 102*b* of the passage 102 unobstructed and then moves into contact with the laminated cutting edges 108, which pierce and/or cut the insulation layer of the wire 16. The continued (relative) movement of the wire 16 through the holding portion 102*a* of the passage 102 displaces and/or removes portions of the insulation layer from the conductor, which then comes into contact with the first inner side surfaces 52 of the cutter plates 20. Pieces of the insulation layer that are removed from the conductor may be accommodated within the notches 58 of the cutter plates 20 and/or at the bottom of the pocket 114. The conductor of the wire 16 is held in the holding portion 102*a* of the passage 102 and engages the first inner side surfaces 52 of the cutter plates 20, thereby making an electrical connection between the wire 16 and the IDT 12.

As the IDT 12 moves into the pocket 114, the barbs 92 contact the interior side surfaces 116 of the housing 14 and are resiliently deflected. The IDT 12 continues to move downward until the second sloping portions 88*c* of the outer side surfaces 88 of the holding plates 24 contact the interior side surfaces 116 of the housing 14. At this point, further downward movement of the IDT 12 is prevented. The wire 16 is disposed in the holding portion of the passage 102 and is trapped between and abuts the closed end of the passage 102 and the abutment surface 120 of the housing 14. The barbs 92 exert forces against the interior side surfaces 116 to retain the IDT 12 in the pocket 114. Moreover, the conductor of the wire 16 is electrically connected to the IDT 12.

Figure 8:
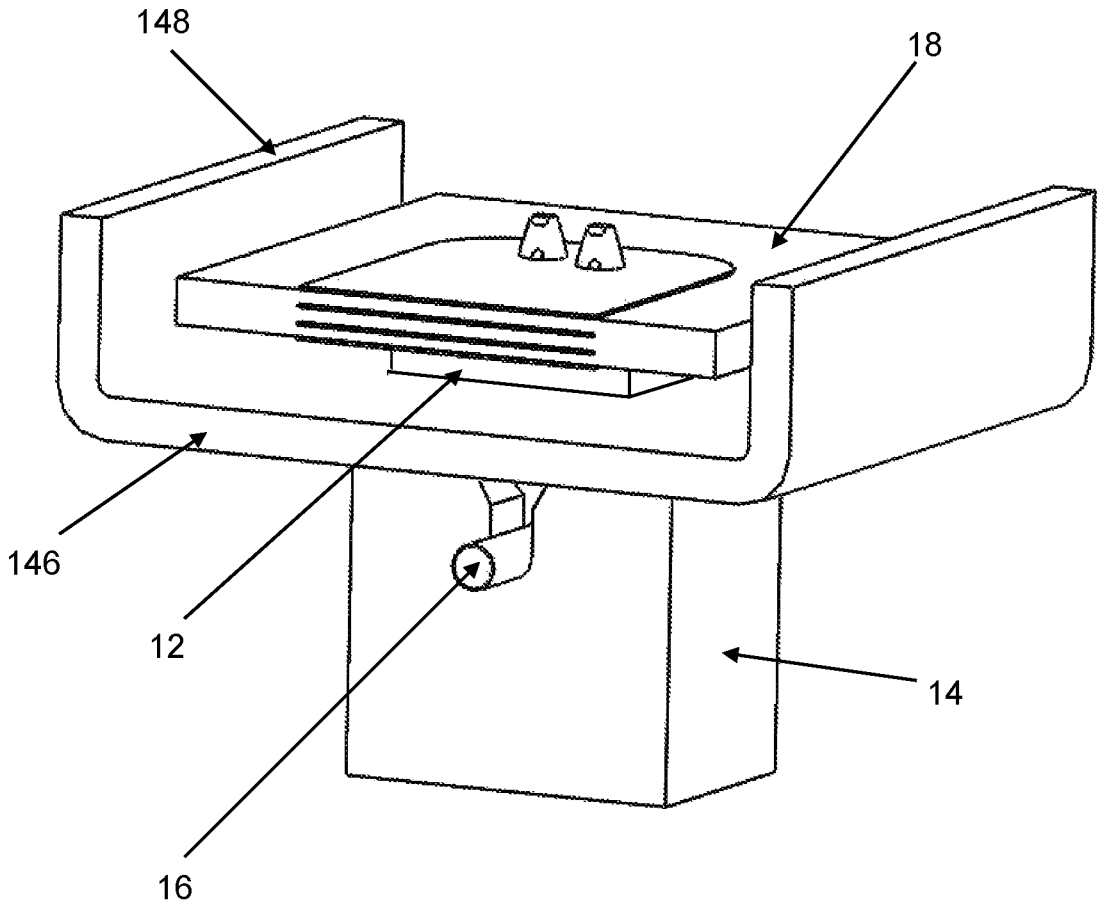
FIG. 8 shows a schematic view of an IDC connecting a wire to a printed circuit board through a wall of an enclosure.
Figure 9:
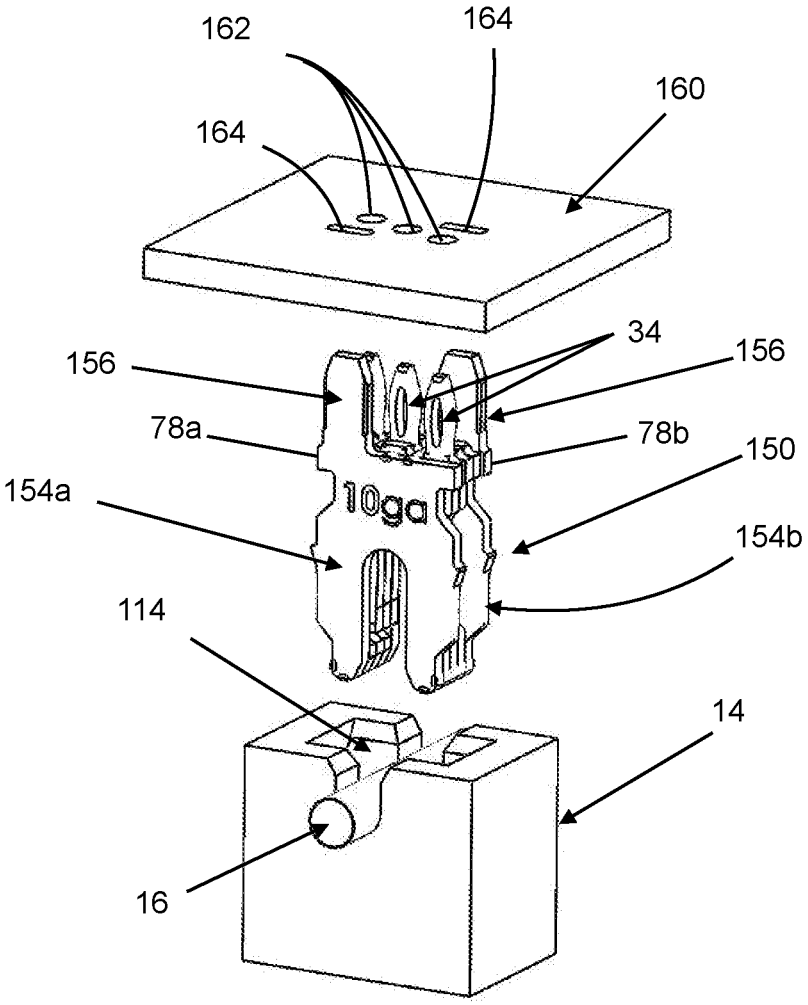
FIG. 9 shows a partially exploded perspective view of an IDC having an IDT constructed in accordance with a third embodiment.

When the IDT 12 is fully disposed in the pocket 114, the base 98 of the IDT 12 is disposed above the housing 14 so as to be exposed, i.e., the housing 14 is separated from the contact projections (e.g., 34). This separation permits the IDC 10 to be connected through a wall 146 of an enclosure 148, such as is shown in FIG. 8. The distance by which the contact projections 34 are separated from the housing 14 accommodates the thickness of the wall 146 through which the IDT 12 may extend to provide a connection between the wire 16, disposed on one side of the wall 146, and an electrical/electronic device, such as the PCB 18, disposed on the other side of the wall 146. The wall 146 may be sealed around the opening through which the IDT 12 extends to seal the wire 16 from the PCB 18.

The operation of the IDT 12 described above is facilitated by structural features of the IDT 12. The securement of the cutter plates 20 between the holding plates 24 provide the IDT 12 with structural rigidity. This rigidity ensures that the bite of the cutter plates 20 through the insulation layer and the conductor of the wire 16 is properly sized by preventing the engagement legs 32 of the cutter plates 20 from splaying outward during the cutting action. The structural rigidity of the IDT 12 also allows the engagement legs 32 of the cutter plates 20 to function as springs to generate a high normal force connection to the wire 16.

It should be appreciated that other laminated IDTs may be provided for applications other than connecting a wire to a PCB. Non-limiting examples of some of these laminated IDTs are described below. A first one of these examples is the IDT 150 shown in FIG. 9 to which reference is now made. The IDT 150 is adapted for connecting a wire, such as wire 16, to a metal busbar 160 for distributing power. The busbar 160 is composed of a conductive metal, such as a copper alloy, and has a series of holes 162 and a pair of slots 164 extending therethrough.

The IDT 150 has the same construction as the IDT 12, except the IDT 150 has holding plates 154 instead of the holding plates 24. The holding plates 154 have the same construction as the holding plates 24, except the holding plates 154 each have a tongue 156 joined to the upper edge 74 and extending upwardly therefrom. The tongues 156 each have a tapered free end. The tongues 156 are located proximate to the shoulders 78 one opposing sides of the IDT 15, respectively, i.e., are arranged diagonal to each other. In this manner, the tongues 156 and the contact projections 34 form an outline of a parallelogram, as viewed from the top of the IDT 150.

The arrangement of the tongues 156 and the contact projections 34 of the IDT 150 corresponds to the arrangement of the holes 162 and the slots 164, respectively, of the busbar 160. Moreover, the contact projections 34 are sized to resiliently deform when they are pressed into the holes 162, respectively, and the tongues 156 are sized to be snugly received in the slots 164, respectively. The outward forces applied by the beams 40 of the contact projections 34 against the inner walls of the busbar 160 defining the holes 162 helps retain the contact projections 34 in the holes 162. The disposal of the tongues 156 in the slots 164 provides strain relief that helps prevent cold-working of the holes 162 by the contact projections 34.

Figure 10:
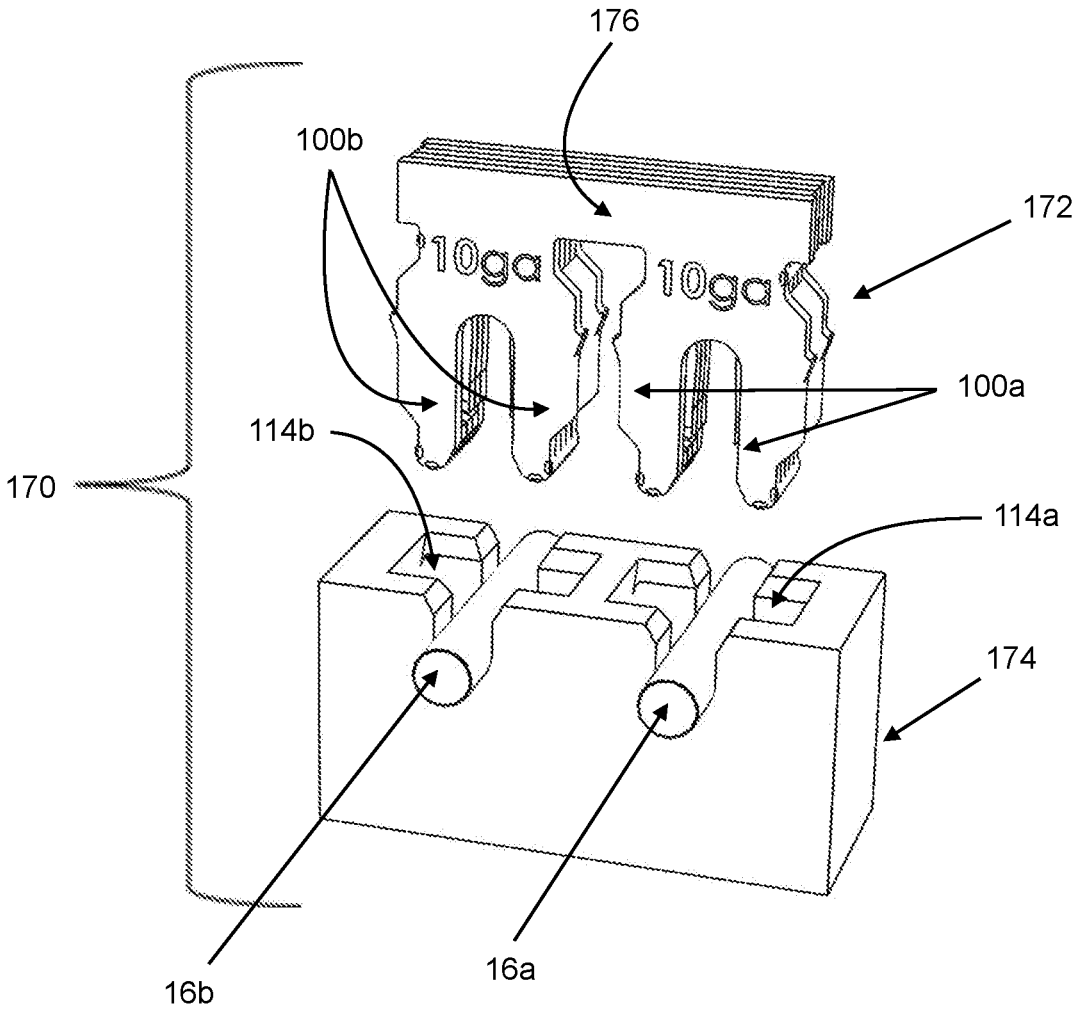
FIG. 10 shows a partially exploded perspective view of an IDC having an IDT constructed in accordance with a fourth embodiment.
Figure 11:
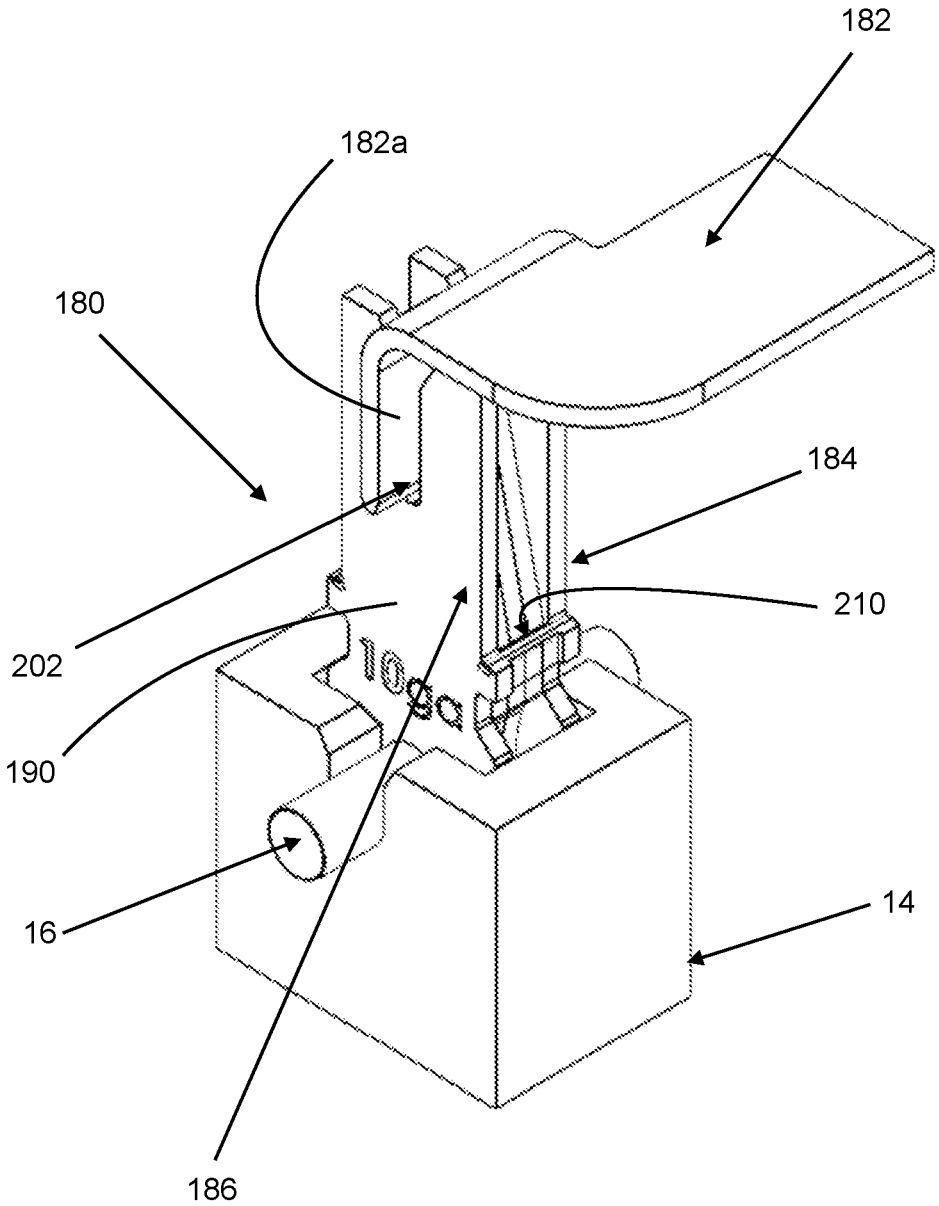
FIG. 11 shows a perspective view of an IDC having an IDT constructed in accordance with a fifth embodiment, with the IDC being connected to a bar.
Figure 12:
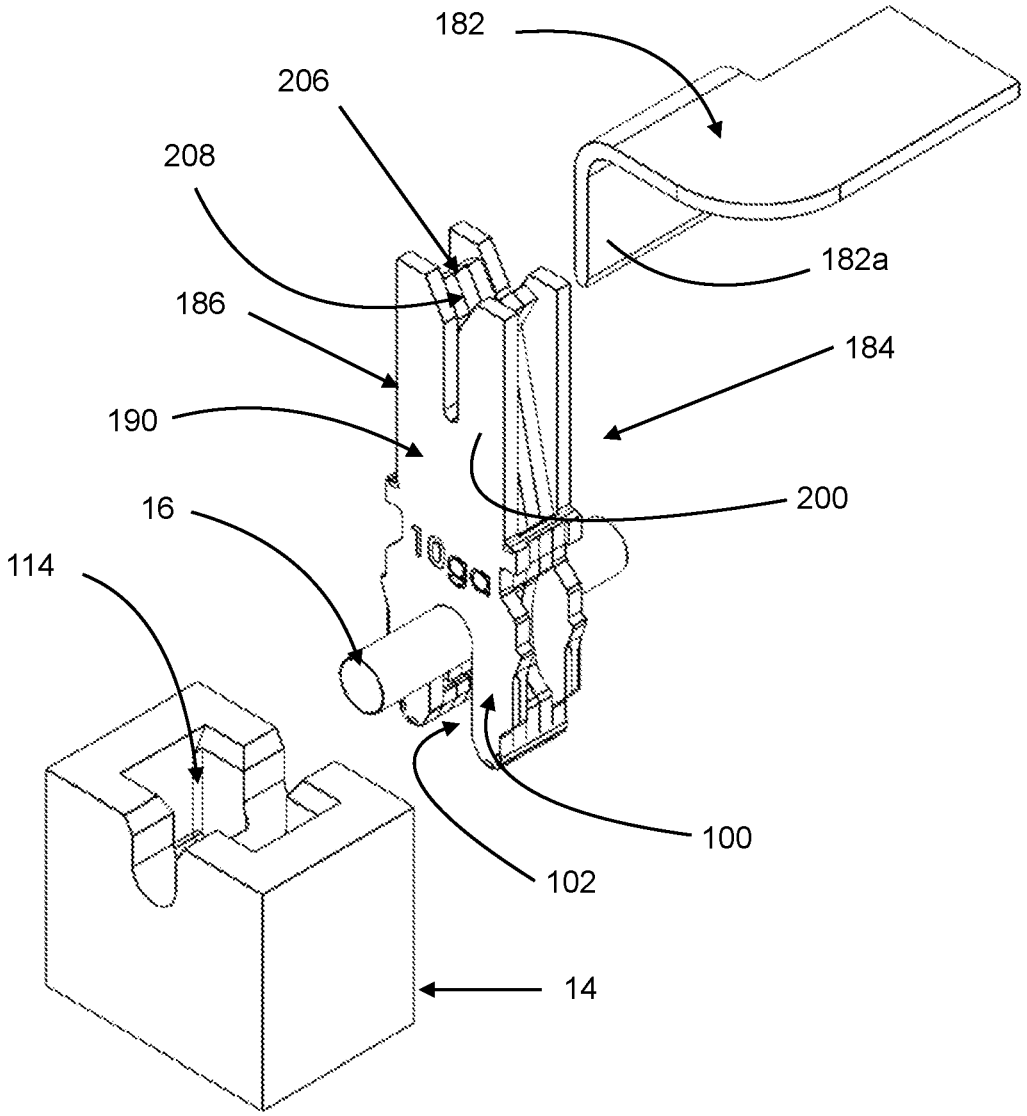
FIG. 12 shows a partially exploded perspective view of the IDC of FIG. 11, with the bar removed from the IDC.
Figure 13:
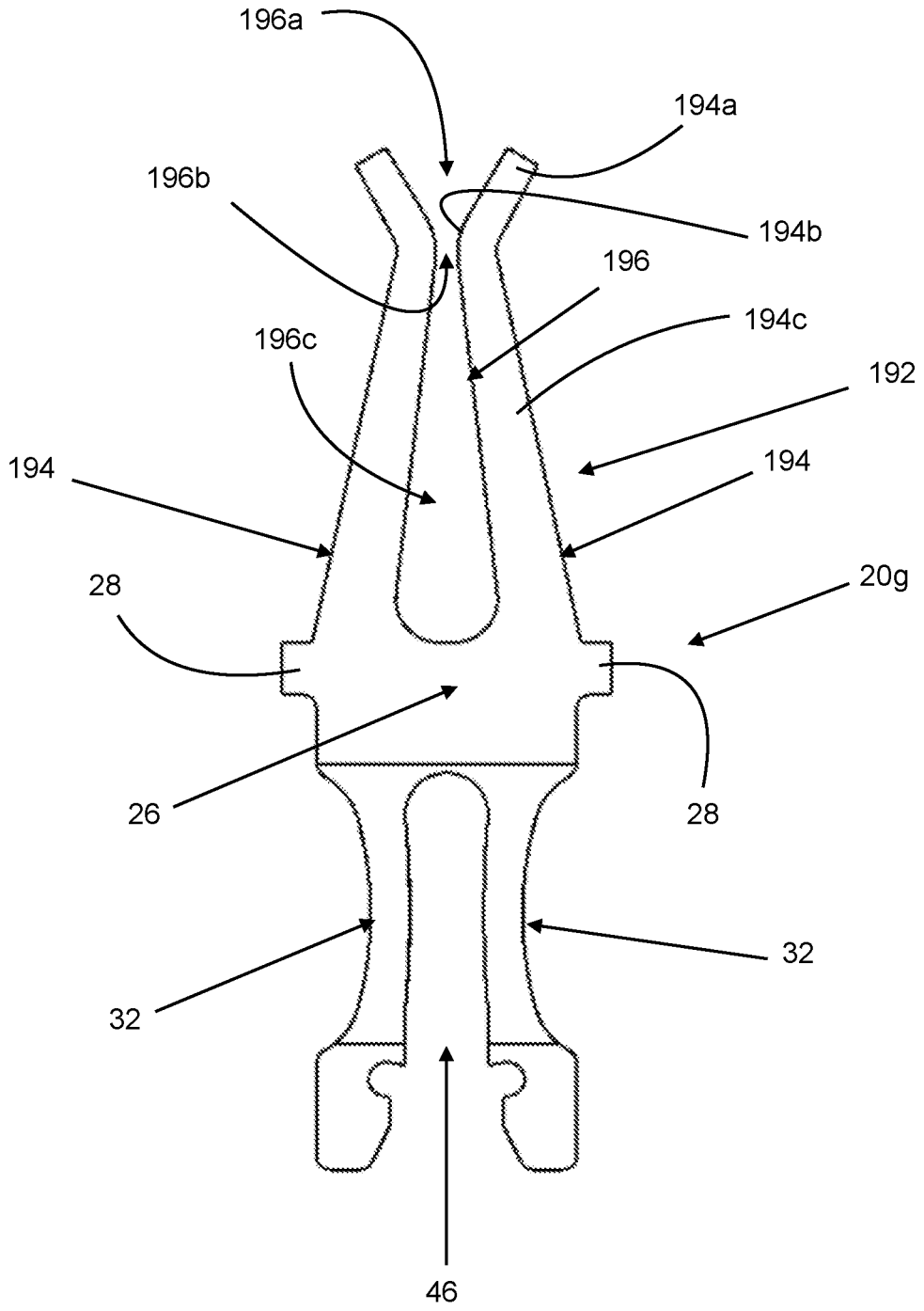
FIG. 13 shows a front view of a cutter plate of the IDT shown in FIGS. 11 and 12.
Figure 14:
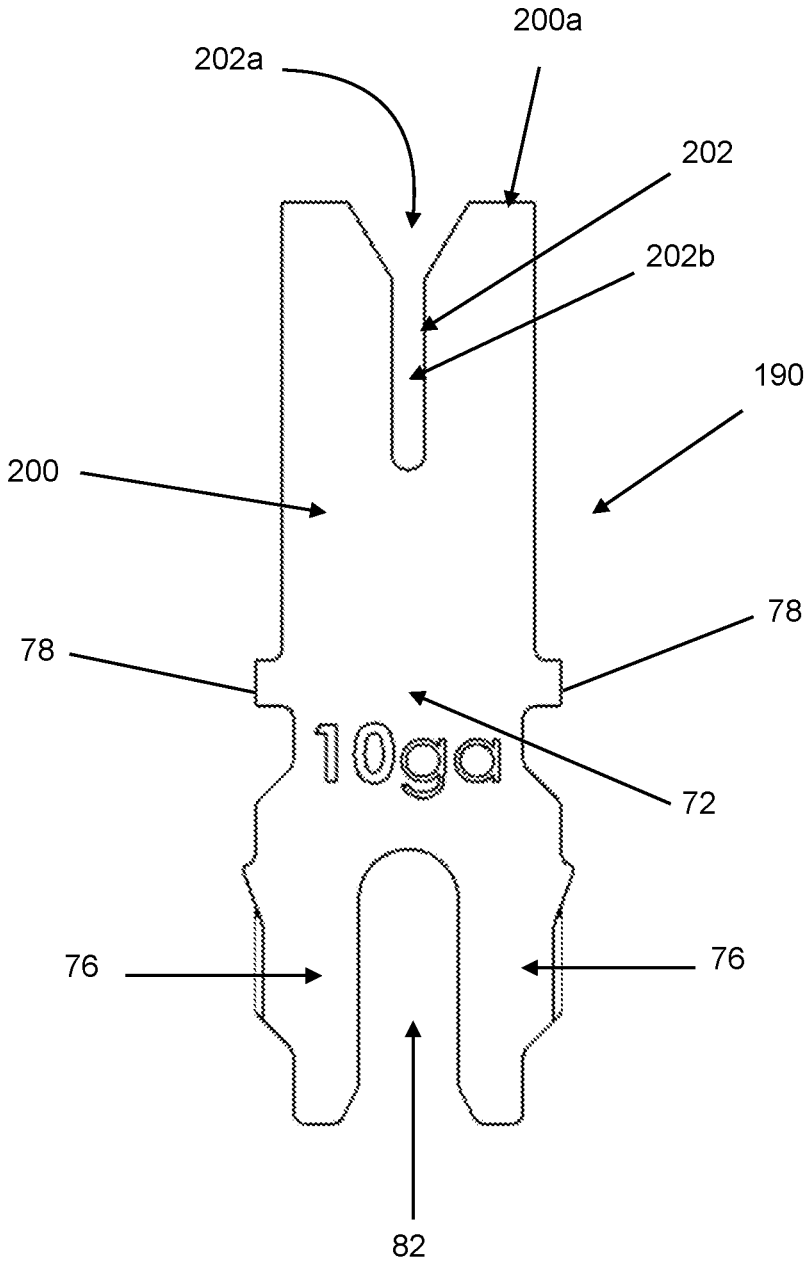
FIG. 14 shows a front view of a holding plate of the IDT shown in FIGS. 11 and 12.
Figure 15:
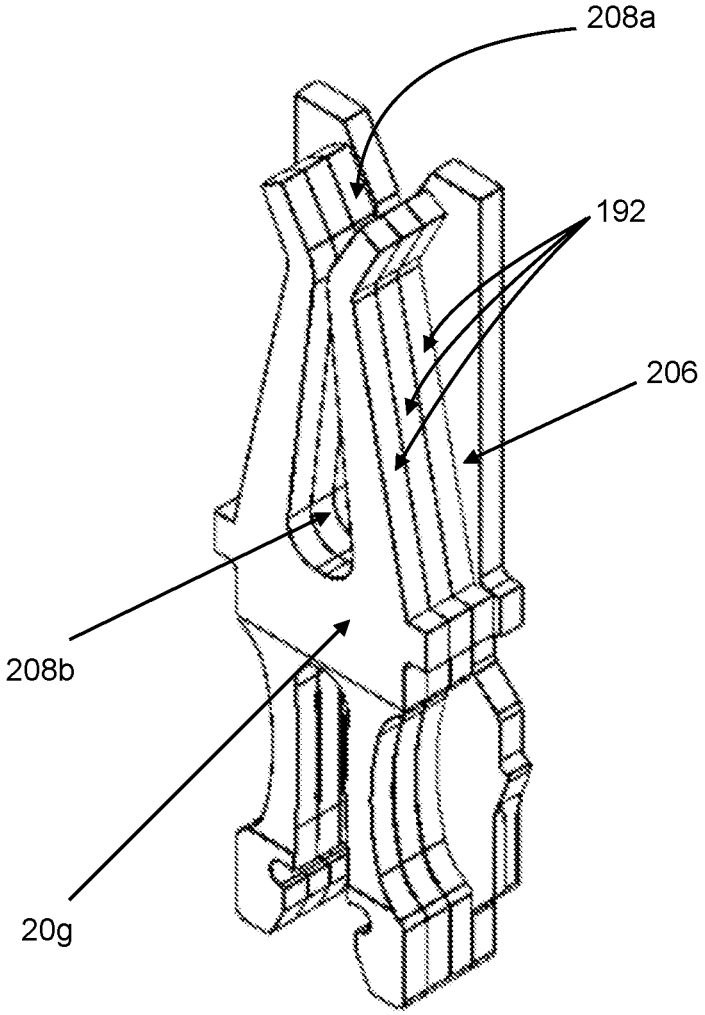
FIG. 15 shows a front perspective of the IDT shown in FIGS. 11 and 12, with a front holding plate removed.
Figure 16:
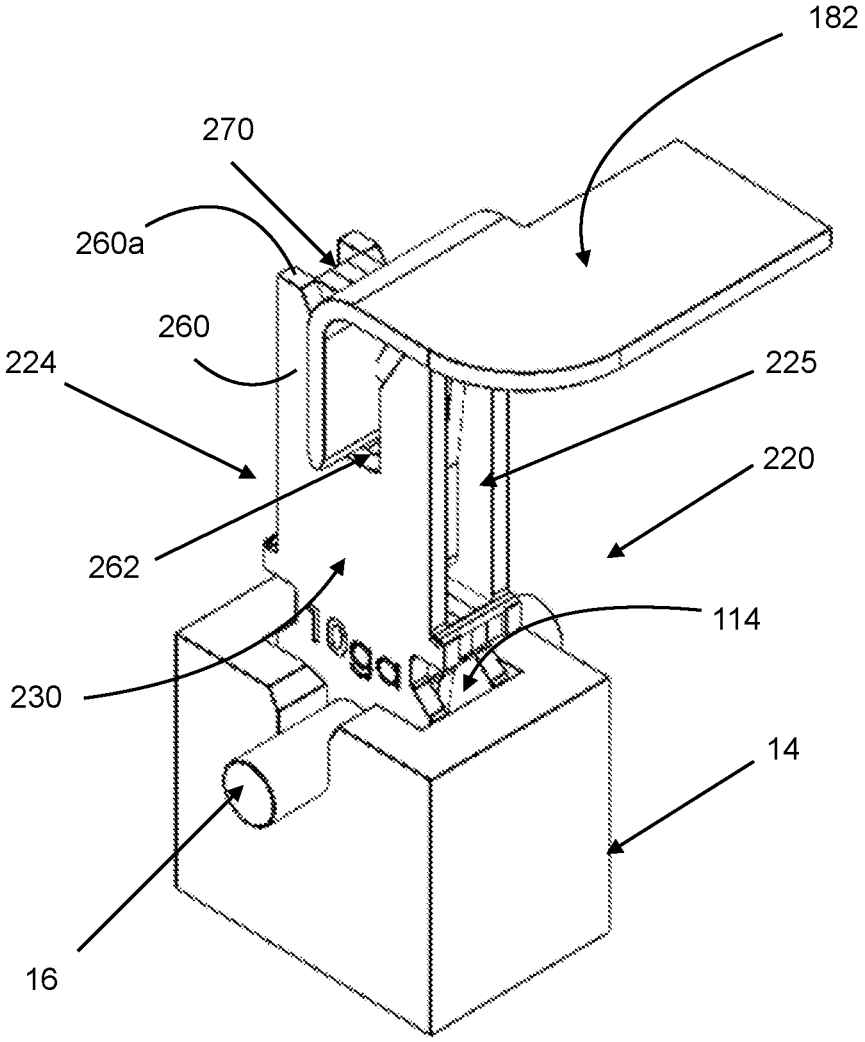
FIG. 16 shows a perspective view of an IDC having an IDT constructed in accordance with a sixth embodiment, with the IDC being connected to a bar.
Figure 17:
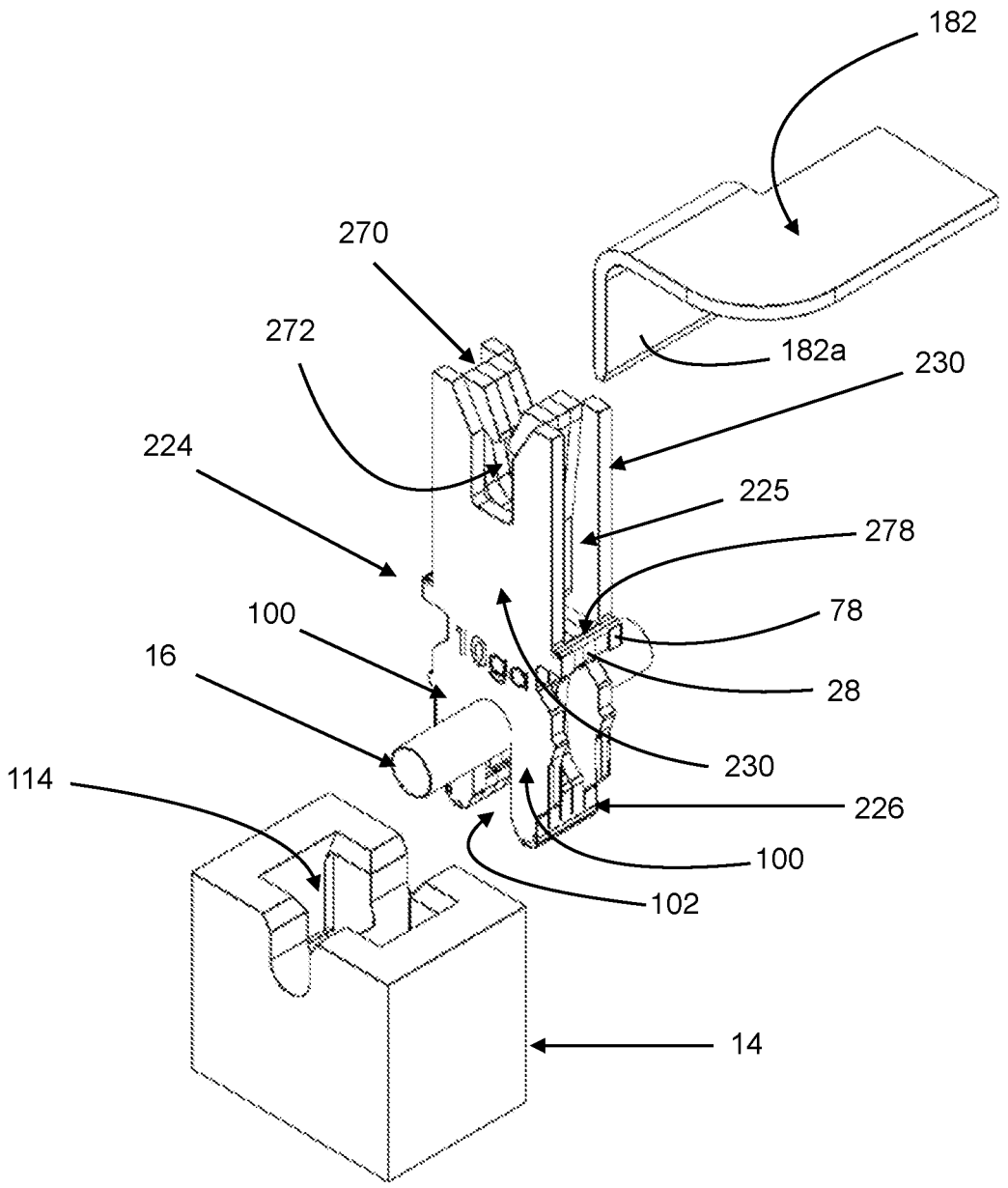
FIG. 17 shows a partially exploded perspective view of the IDC of FIG. 16, with the bar removed from the IDC.
Figure 18:
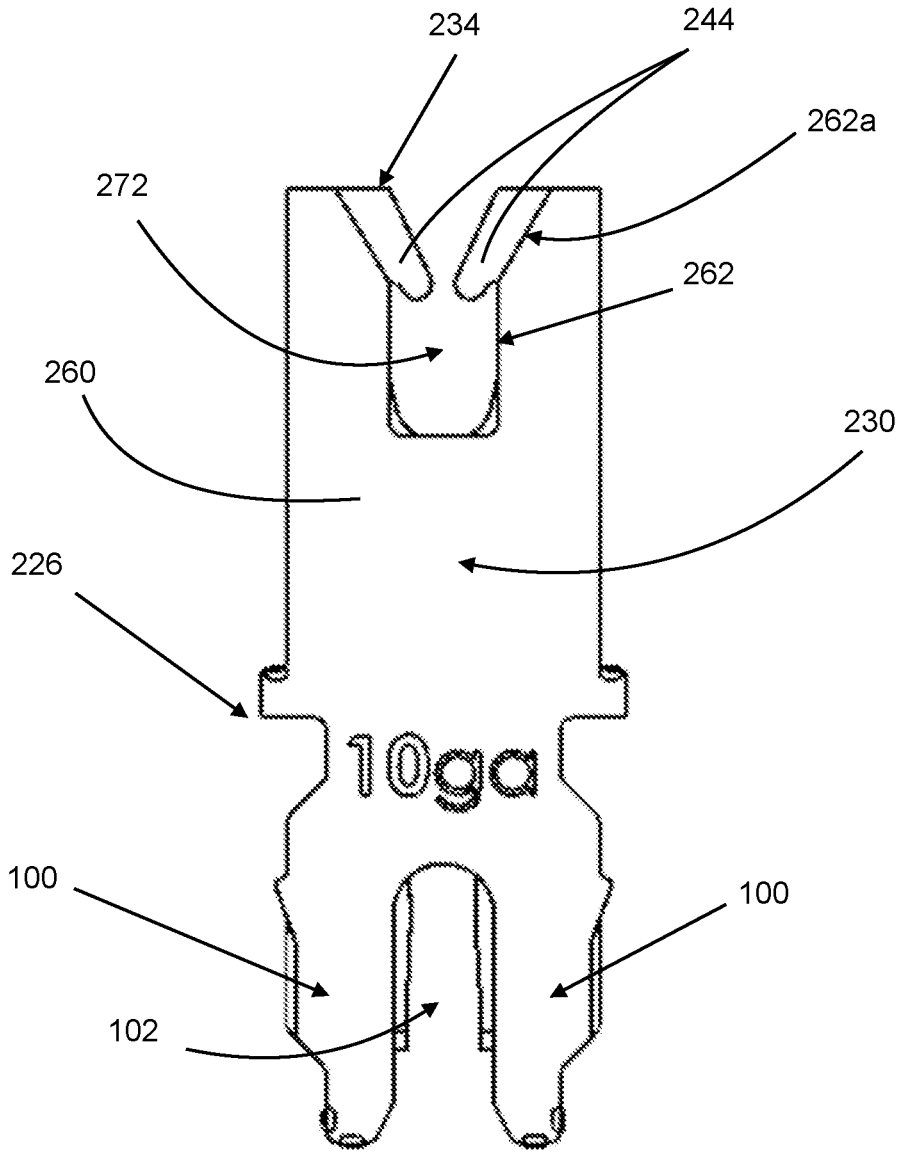
FIG. 18 shows a front view of the IDT of FIGS. 16 and 17.
Figure 19:
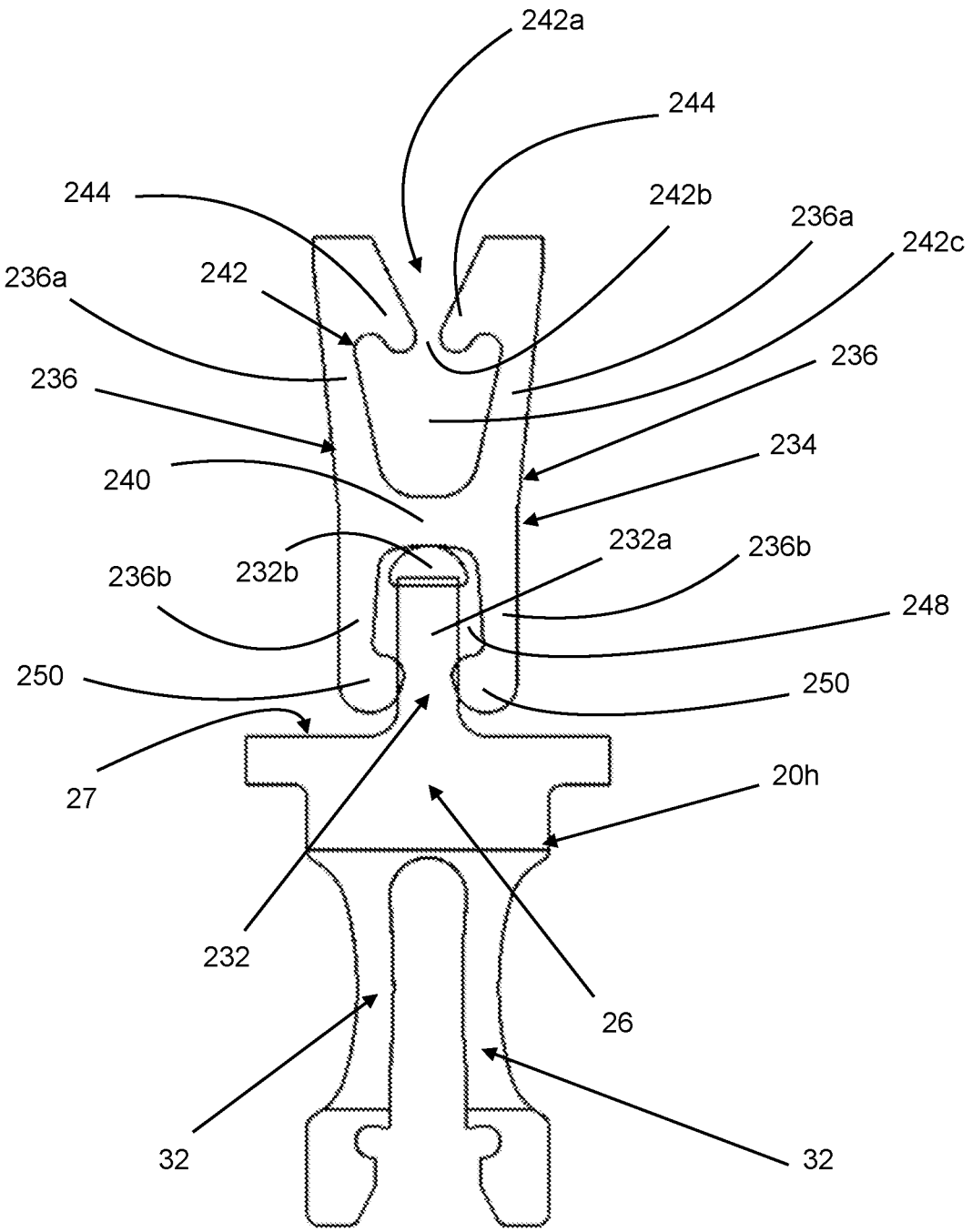
FIG. 19 shows a front view of a cutter plate and a contact plate of the IDT of FIGS. 16-18, with the cutter plate being connected to the contact plate.
Figure 20:
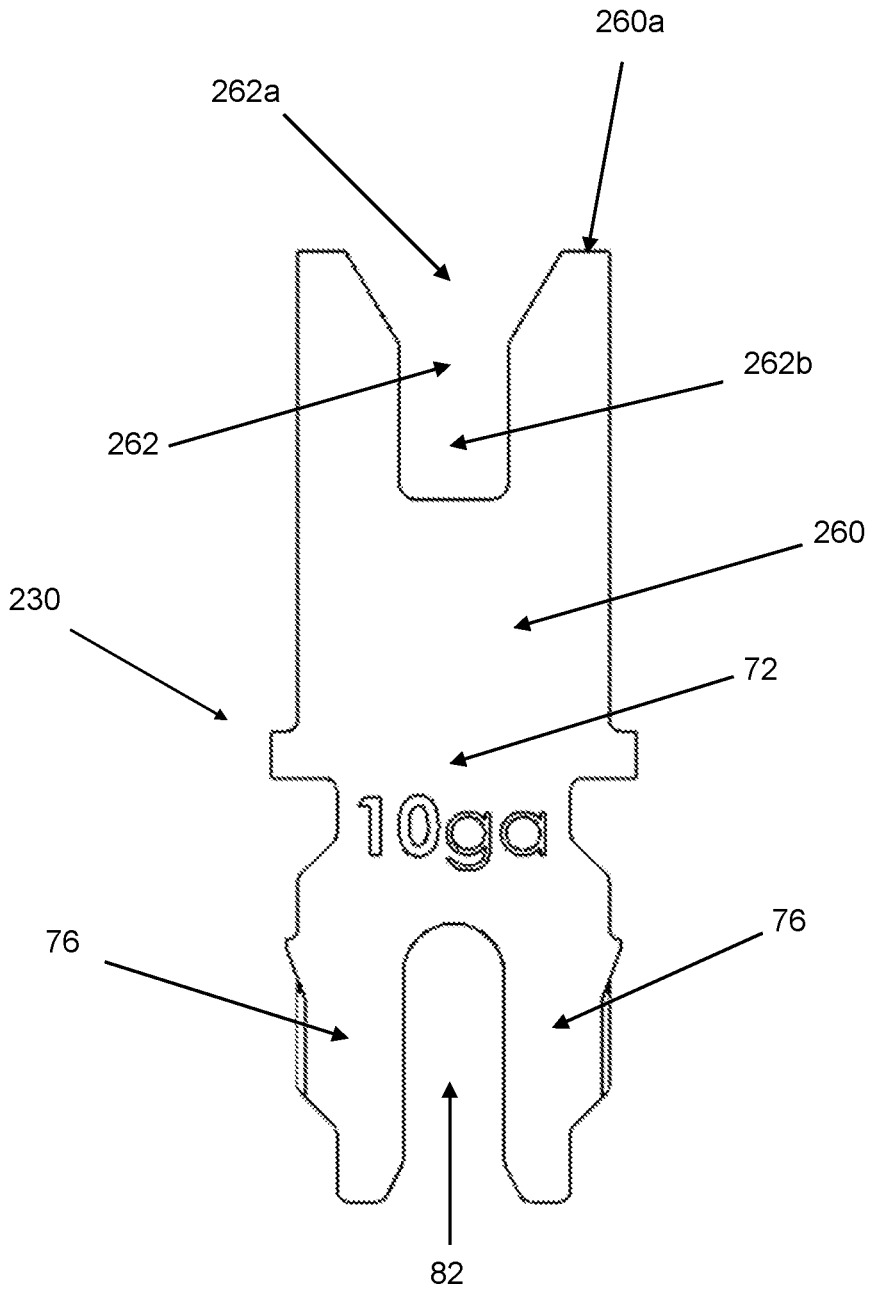
FIG. 20 shows a front view of a holding plate of the IDT of FIGS. 16-18.
Figure 21:
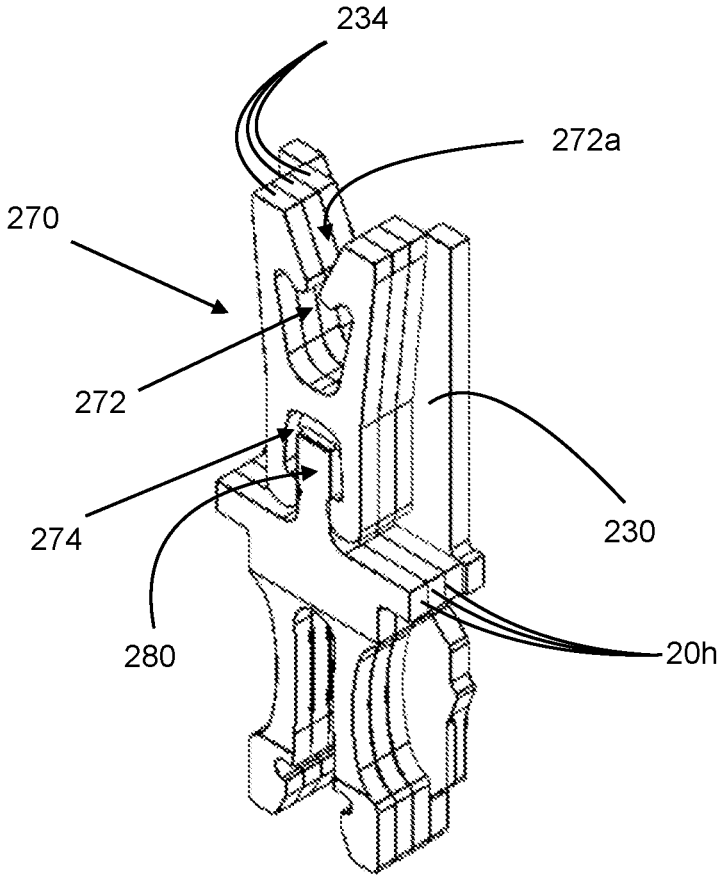
FIG. 21 shows a front perspective view of the IDT of FIGS. 16-18, with a front holding plate removed.

Referring now to FIG. 10, there is shown an IDC 170 for connecting together (e.g. splicing) two wires 16*a,b*. The IDC 170 includes a laminated IDT 172 and a housing 174.

Except as described below, the IDT 172 has the same construction as two IDTs 12 arranged side-by-side and integrally joined together at their shoulders. A base 176 of the IDT 172, including its shoulders, is higher than the base 98 of the IDT 12 and its shoulders. In addition, the base 176 of the IDT 172 is wider than the combined length of the bases 98 of two IDTs 12 due to the additional length in the center necessary to separate the two pairs of inner legs 100 of the IDT 172. Although the IDT 172 is shown as not having any contact projections extending from its upper surface, it should be appreciated that in other embodiments, the IDT 172 may have contact projections (such as pins or contact projections 34).

The housing 174 has the same construction as two housings 14 arranged side-by-side and integrally joined together. The spacing between the pockets 114*a,b* of the housing 174 corresponds to the spacing between the two pairs of legs 100*a,b*. In this manner, a first pair of the legs 100*a* may be inserted into the pocket 114*a* at the same time a second pair of the legs 100*b* is inserted into the pocket 114*b*. When the wires 16*a,b* extend through the routes in the housing 174, as shown, and the pairs of legs 100 are inserted into the pockets 114*a,b*, the laminated cutting edges 108 of the legs 100 remove the insulation layers from the conductors of the wires 16*a,b*, which then come into contact with the legs 100, thereby electrically connecting each of the wires 16*a,b* to the IDT 172 and in so doing, electrically connecting together the wires 16*a,b*.

Referring now to FIGS. 11-15, there is shown an IDC 180 for connecting a wire 16 to a bar 182 (such as a power busbar) that does not have holes formed therein. The IDC 180 includes an IDT 184 and a housing 14.

The IDT 184 includes a plurality of plates arranged in a stack 186. The plates include a plurality of cutter plates 20*g* disposed between outer holding plates 190. The plates 20*g*,190 may directly contact each other or be separated by a thin dielectric layer. Each cutter plate 20*g* has a contact projection 192 joined to and extending upward from the upper edge 27 of the base 26. The contact projection 192 has a configuration similar to a tuning fork and comprises a pair of arms or tines 194, each of which are gently tapered and have an outer end portion 194*a* joined at a bend 194*b* to a main portion 194*c*. The tine main portions 194*c* slope inwardly, toward each other, while the tine outer end portions 194*a* extend outwardly, respectively. As such, the tines 194 define a spacing 196 having a V-shaped outer portion 196*a* located between the tine outer end portions 194*a*, a narrow neck portion 196*b* located between the tine bends 194*b* and a teardrop-shaped inner portion 196*c* defined by the tine main portions 194*c*.

The holding plates 190 (shown best in FIG. 14) have the same construction as the holding plates 24, except the holding plates 190 each have a body 200 integrally and seamlessly joined to the upper edge 74 and extending upwardly therefrom. The bodies 200 each have a slot 202 formed therein, which extends through an upper free end 200*a* of the body 200. Each slot 202 has an outer portion 202*a* that is V-shaped and a main portion 202*b* having a constant width, except at a bottom closed end of the slot 202. The slot outer portion 202*a* corresponds to the V-shaped outer portion 196*a* of the spacing 196 in the contact projections 192. The width of the slot main portion 202*b* is slightly wider than the spacing neck portion 196*b* in the contact projections 192.

The cutter plates 20*g* and the holding plates 190 are arranged in the stack 186 in a manner similar to the plates 20, 24 in the stack 22 of the IDT 12 so as to provide the IDT 184 with a pair of legs 100 separated by a passage 102. In addition, the contact projections 192 of the cutter plates 20*g* cooperate to define a laminated contact projection 206 having a slot 208 adapted to receive the bar 182. The slot 208 includes a V-shaped outer portion 208*a* and a main portion 208*b*. The V-shaped outer portion 208*a* is formed by the outer portions 196*a* of the cutter plates 20*g*. The slot 208 extends in the stacking direction of the cutter plates 20*g* and is aligned with the slots 202 in the holding plates 190.

It is noted that with regard to the IDT 184, the X-direction of the IDT 184 is the stacking direction of the cutter plates 20*g*, the Y-direction of the IDT 184 is the lateral direction (from leg 100 to leg 100) and the Z-direction is the vertical direction, i.e., the direction in which the legs 100 extend.

The plates 20*g*, 190 are secured together in the stack 186 by mechanical means and/or by welding. The plates 20*g*, 190 may be mechanically held together by a bracket or a band in a press-fit manner. For example, a metal band may tightly extend around the IDT 184, just below the the shoulders 28, 78 of the cutter plates 20*g* and the holding plates 190. The plates 20*g*, 190 may be welded together in the same manner as the plates 20, 24 in the stack 22, except for the absence of the upper welds 110. Instead of having upper welds 110, the stack 186 has upper welds 210 that extend across the tops of the shoulders 28, 78 of the cutter plates 20*g* and holding plates 190, respectively. In this manner, the upper welds 210 are disposed at the bottom of, and on opposing sides of, the laminated contact projection 206. This location permits individual movement of the tines 194 of the cutter plates 20*g* when they are deflected outward by the insertion of the bar 182 in the slot 208 and/or when they resiliently return to their original position if the bar 182 is subsequently removed from the slot 208.

The electrical connection of the IDT 184 to the wire 16 in the housing 14 is the same as the IDT 12 described above. The IDT 184 may be electrically connected to the bar 182 by moving a blade portion 182*a* of the bar 182 vertically downward (in the Z-direction) into the slot 208 through the outer portion 208*a*. As the blade portion 182*a* moves downward, the blade portion 182 contacts the tine bends 194*b* of the cutter plates 20*g*, thereby deflecting them outward. The tine bends 194*b* maintain contact with the blade portion 182 after the blade portion 182*a* is fully disposed in the slot 208, thereby establishing an electrical connection between the bar 182 and the IDT 184 and, thus, the wire 16.

It should be appreciated that the IDT 184 may be connected to bars with configurations different than the bar 182 and in a different manner. For example, the slot 208 may receive the end of a straight bus bar that is oriented with its longitudinal axis extending in the direction of the Z-axis of the IDT 184.

Referring now to FIGS. 16-21, there is shown an IDC 220 for connecting a wire 16 to a bar 182 (such as a power busbar) that does not have holes formed therein. The IDC 220 includes an IDT 224 and a housing 14. The IDT 224 is adapted for accommodating misalignment between the bar 182 and the IDT 224 when they are connected together. More specifically, the IDT 224 includes a coupler 225 for providing a connection to the bar 182.

The IDT 224 includes a plurality of plates arranged in a stack 226. The plates include a plurality of cutter plates 20*h* (shown best in FIG. 19) disposed between outer holding plates 230. The plates 20*h*, 230 may directly contact each other or be separated by a thin dielectric layer. Each cutter plate 20*h* has a contact projection 232 joined to and extending upward from the upper edge 27 of the base 26. The contact projection 232 has a rectangular body 232*a* joined to an enlarged head 232*b* with an outer arcuate edge. As will be described more fully below, the contact projections 232 are connected to contact plates 234, respectively.

Each of the contact plates 234 (also shown best in FIG. 19) is a unitary or monolithic structure and is electrically conductive, being composed of a conductive metal, such as a tin plated copper alloy. Each contact plate 234 includes a pair of irregular-shaped elements or arms 236, which have upper portions 236*a* and lower portions 236*b*, respectively. The arms 236 are joined together by a cross bar 240, intermediate the upper and lower portions. The cross bar 240 extends laterally between the arms 236 and helps give the contact plate 234 a general H-shape. The upper portions 236*a* are separated by an upper spacing 242 and have nose-shaped projections 244, respectively, that slope downwardly and inwardly to rounded interior ends. In this manner, the projections 244 provide the upper spacing 242 with a general V-shape entrance 242*a* and define a narrow inner gap 242*b* that adjoins the entrance 242*a*. The inner gap 242*b* connects the entrance 242*a* to an inner portion 242*c* of the upper spacing 242. The lower portions 236*b* are separated by a lower spacing 248 and have inwardly-directed, bulbous protrusions 250, respectively. The protrusions 250 narrow an entrance to the lower spacing 248.

The holding plates 230 (shown best in FIG. 20) have the same construction as the holding plates 24, except the holding plates 230 each have a body 260 integrally and seamlessly joined to the upper edge 74 and extending upwardly therefrom. The bodies 260 each have a slot 262 formed therein, which extends through an upper free end 260*a* of the body 260. Each slot 262 has an outer portion 262*a* that is V-shaped and a main portion 262*b* having a constant width. Although the slot outer portions 262*a* are aligned with the V-shaped entrances 242*a* of the upper spacings 242, the slot outer portions 262*a* are wider in the Y-direction than the upper spacing entrances 242*a*.

Before the cutter plates 20*h* and the holding plates 230 are arranged together to form the stack 226, the contact plates 234 are connected to the cutter plates 20*h*, respectively. More specifically, the contact projections 232 of the cutter plates 20*h* are inserted into the lower spacings 248 of the contact plates 234 by moving the contact projection bodies 232*a* in the stacking direction through the lower spacing entrances. With the cutter plates 20*h* and the contact plates 234 so arranged, the holding plates 230 are then secured to the cutter plates 20*h* by mechanical means and/or by welding, thereby preventing displacement of the contact plates 234 in the stacking direction. Since the contact projection heads 232*b* are too wide to pass through the lower spacing entrances of the contact plates 234, the contact plates 234 are prevented from being displaced in the vertical (Z) direction. In this manner, the cutter plates 20*h* and the holding plates 230 cooperate to hold the contact plates 234 in place and thereby form the coupler 225, i.e., the coupler 225 is formed by the contact plates 234, the cutter plates 20*h* and the holding plates 230. Although the contact plates 234 are held by the cutter plates 20*h* and the holding plates 239, the contact plates 234 can still pivot about the contact projection heads 232*b*.

In the coupler 225, the contact plates 234 are disposed with their planar surfaces adjoining each other, to form a stack 270. The contact plates 234 are aligned with each other such that the upper spacings 242 form a first receiving slot 272 and the lower spacings 248 form a second receiving slot 274. The first receiving slot 272 includes a V-shaped outer portion 272*a*. The first and second receiving slots 272, 274 extend in the stacking direction, which is normal to the planar surfaces of the contact plates 234. The number of contact plates 234 is equal to the number of cutter plates 20*h*; this number being determined by the amount of electrical current the coupler 225 (and the IDT 224) are designed to handle, with the current carrying capacity of the coupler 225 (and the IDT 224) being increased by increasing the number of contact plates 234 and cutter plates 20*h* that are used. Other factors that affect the current carrying capacity of the coupler 225 (and the IDT 224) include the thickness of each contact plate 234 and each cutter plate 20*h*, the type of plating used and the composition of the underlying metal structure.

Figure 23:
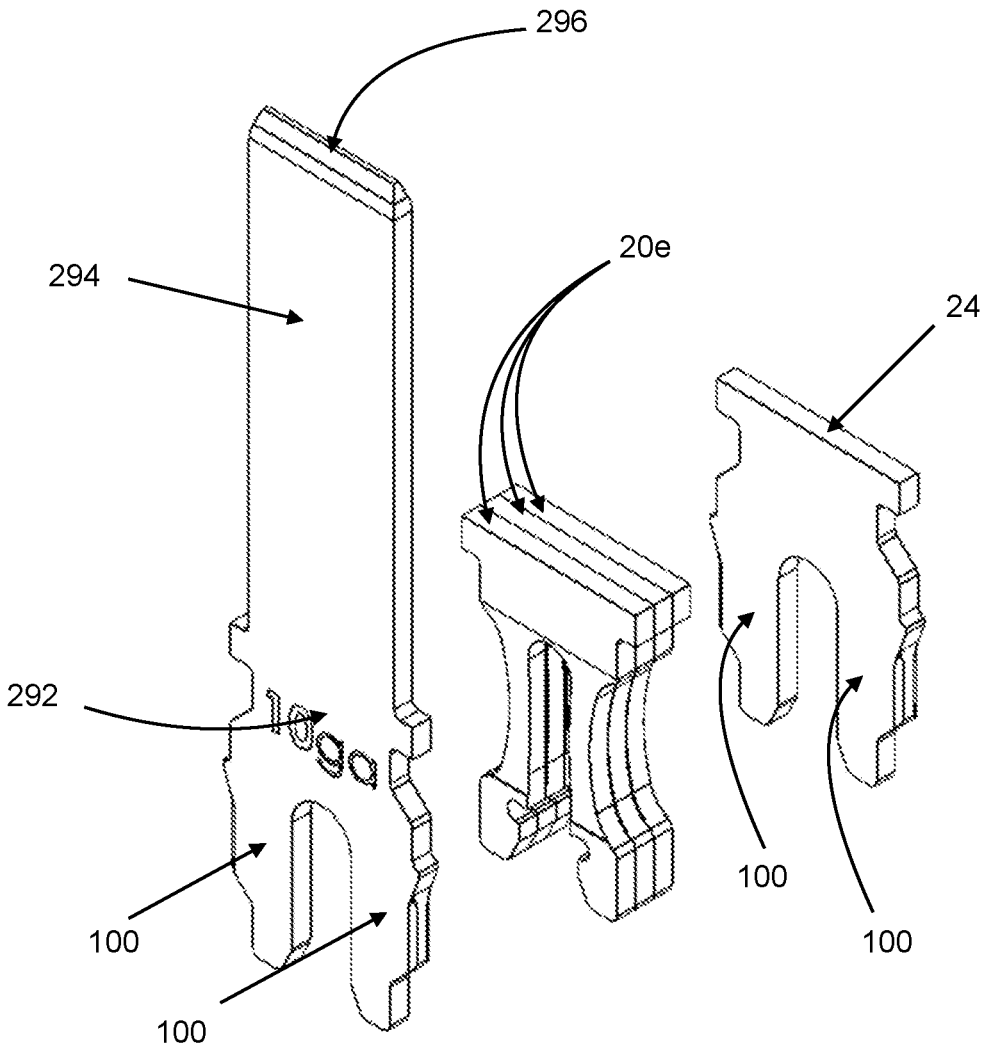
FIG. 23 shows a partially exploded perspective view of the IDT of FIG. 22.

The cutter plates 20*h* and the holding plates 230 are arranged together in the stack 226 in a manner similar to the plates 20, 24 in the stack 22 of the IDT 12 so as to provide the IDT 224 with a pair of legs 100 separated by a passage 102. In addition, the contact projections 232 of the cutter plates 20*h* adjoin each other to form a laminated ridge 280, which is disposed in the second receiving slot 274, as best shown in FIG. 23.

It is noted that with regard to the IDT 224, the X-direction of the IDT 224 is the stacking direction of the cutter plates 20*h*, the Y-direction of the IDT 224 is the lateral direction (from leg 100 to leg 100) and the Z-direction is the vertical direction, i.e., the direction in which the legs 100 extend.

The plates 20*h*, 230 are secured together in the stack 226 by mechanical means and/or by welding in the same manner as the plates 20, 24 in the stack 22, except, in the case of welding, for the absence of the upper welds 110. Instead of having upper welds 110, the stack 226 has upper welds 278 that extend across the tops of the shoulders 28, 78 of the cutter plates 20*h* and holding plates 230, respectively. As such, the upper welds 278 are disposed at the bottom of, and on opposing sides of, the laminated ridge 280.

The electrical connection of the IDT 224 to the wire 16 in the housing 14 is the same as the IDT 12 described above. The IDT 224 may be electrically connected to the bar 182 by moving a blade portion 182*a* of the bar 182 vertically downward into the first receiving slot 272 through the outer portion 272*a*. As the blade portion 182*a* moves downward, the blade portion 182 contacts the interior ends of the projections 244 of the contact plates 234, thereby deflecting them outward. The projections 244 maintain contact with the blade portion 182 after the blade portion 182*a* is fully disposed in the slot 272, thereby establishing an electrical connection between the bar 182 and the coupler 225 and, thus, the IDT 224 and the wire 16.

It should be appreciated that the IDT 224 may be connected to bars with configurations different than the bar 182 and in a different manner. For example, the first receiving slot 272 may receive the end of a straight bus bar that is oriented with its longitudinal axis extending in the direction of the Z-axis of the IDT 224.

The provision of the IDT 224 with the coupler 225 permits some misalignment in the Y-direction between a bar and the first receiving slot. If the bar is offset from the inner gaps 242*b* of the contact plates 234 in the Y-direction when the bar is being moved downward (in the Z-direction) into the first receiving slot 272, the bar will contact the sloping projections 244 of the contact plates 234, which causes the contact plates 234 to pivot about the laminated ridge 280 (the X-axis) and guide the bar into the inner gap 242*b*. Even though the contact plates 234 pivot out of their normal position, they still maintain a good physical and electrical connection with the bar, thereby establishing a good physical and electrical connection between the bar and the IDT 224.

It should be appreciated that in addition to accommodating misalignment in the Y-direction, the coupler 225 also accommodates misalignment in the X-direction and the Z-direction, as well as angular or twist misalignment in any of the three directions. The enlarged size of the slot outer portions 262*a* of the holding plates 230, coupled with their alignment with the first receiving slot 272, permits a bar to be offset in the X-direction vis-a-vis the first receiving slot 272 and still make a good physical and electrical connection with the contact plates 230. In the Z-direction, the bar does not need to extend into the first receiving slot 272 to the full extent possible to make a good physical and electrical connection.

Another advantage provided by the coupler 225 is that it accommodates movement between parts that may occur after the parts have been connected. For example, the parts may move relative to each other due to environmental factors, such as temperature, vibration, impact or handling. The coupler 225 permits this relative movement, while still maintaining a good electrical and physical connection between the parts.

Figure 22:
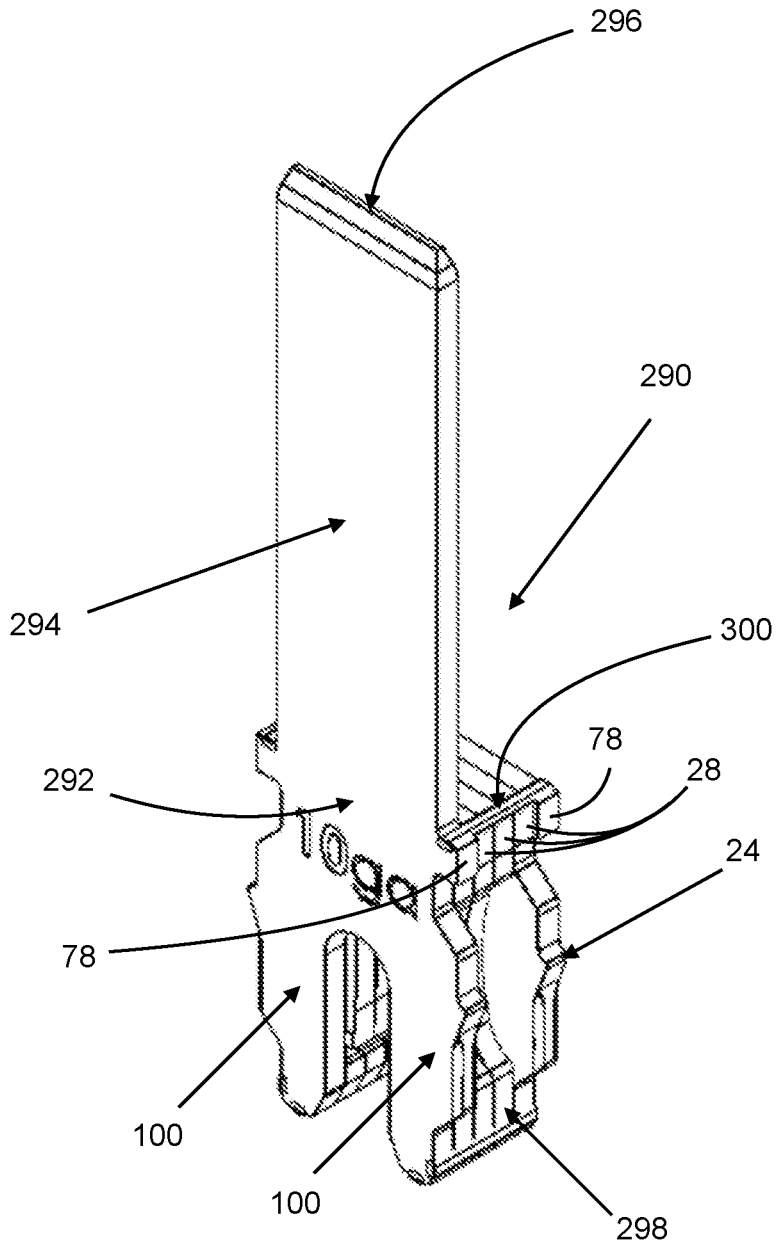
FIG. 22 shows a perspective view of an IDT constructed in accordance with a seventh embodiment.

Referring now to FIGS. 22 and 23, there is shown an IDT 290 for connecting a wire (such as wire 16) to a female connector of an electrical/electronic device. Although not shown, the IDT 290 may be used with a housing 14.

The IDT 290 has the same construction as the IDT 12, except the IDT 290 has three cutter plates 20*e* (with no contact projections), a single holding plate 24 and a holding plate 292. The holding plate 292 has the same construction as the holding plate 24, except the holding plate 292 has a connector blade 294 that is seamlessly joined to the upper edge 74 and extends upward therefrom. The connector blade 294 has a tapered free end 296.

The plates 20*e*, 24, 292 are secured together in a stack 298 by mechanical means and/or welding in the same manner as the plates 20, 24 in the stack 22, except, in the case of welding, for the absence of the upper welds 110. Instead of having upper welds 110, the stack 298 has upper welds 300 that extend across the tops of the shoulders 28, 78 of the cutter plates 20*e* and holding plates 24, 292, respectively.

Figure 24:
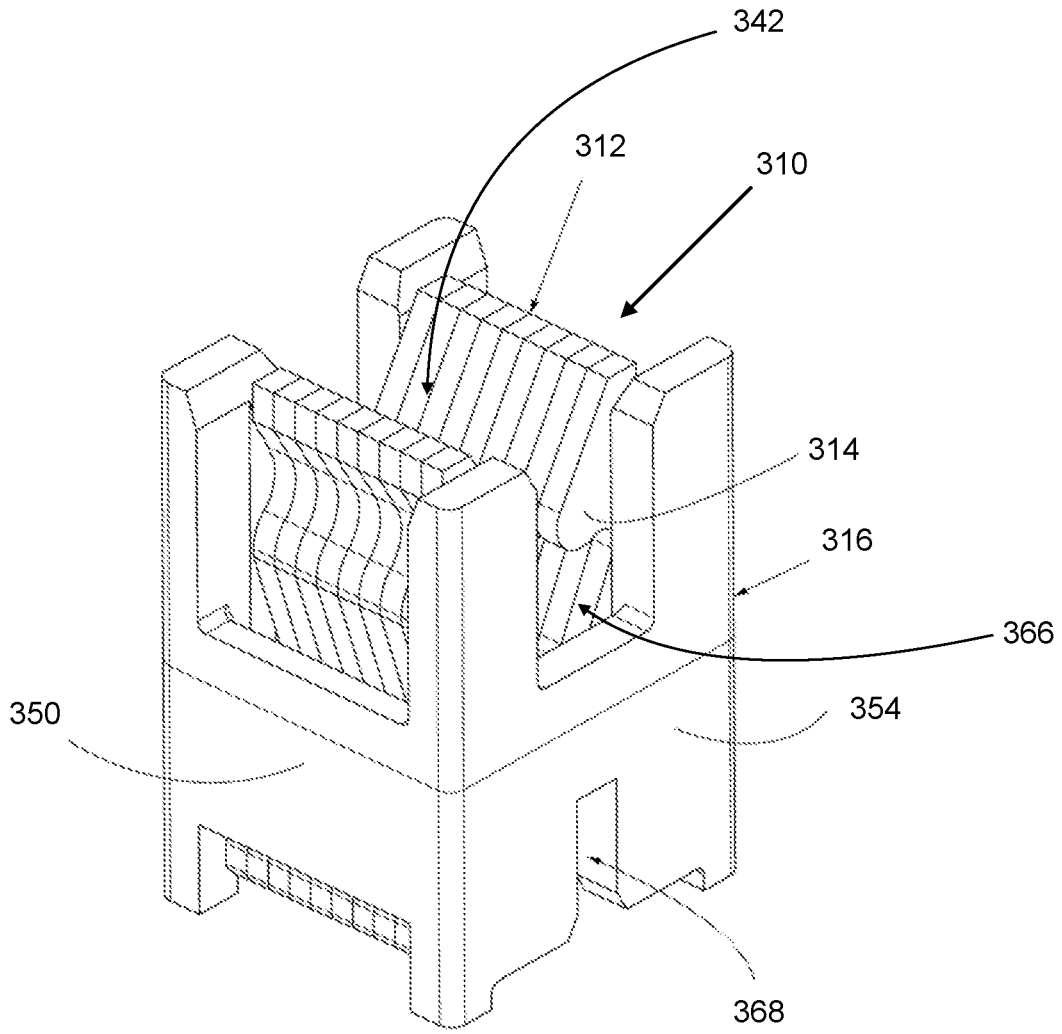
FIG. 24 shows a perspective view of a coupler that may be connected to the IDT of FIGS. 22 and 23.

The connector blade 294 may be used to connect to a female connector, such as a coupler 310 (shown in FIG. 24) constructed in accordance with PCT Application No.: PCT/US17/47800, filed on Aug. 21, 2017 and entitled "ELECTRICAL CONNECTOR", which is hereby incorporated by reference in its entirety. The coupler 310 is comprised of a stack 312 of contact plates 314 disposed in a housing 316. Each of the contact plates 314 is a unitary or monolithic structure and is electrically conductive, being composed of a conductive metal, such as a tin plated copper alloy. The contact plates 314 have a configuration similar to the contact plates 234, i.e., are generally H-shaped. The contact plates 314 are disposed with their planar surfaces adjoining each other, to form the stack 312. However, in other embodiments, the contact plates 314 may be separated by spaces, respectively. The contact plates 314 are aligned with each other so as to form a first receiving groove 342 and a second receiving groove.

The housing 316 is generally cuboid and is composed of an insulative material, such as plastic. The interior of the housing 316 is hollow and is sized to receive the stack 312 of contact plates 314 in a press fit operation, i.e., the interior is smaller in one or more dimensions than the stack 312. The housing 316 includes opposing first side walls 354, opposing second side walls 350 and opposing first and second open ends. The first side walls 354 each have a rectangular major slot 366 disposed toward the first open end and a rectangular minor slot 368 disposed toward the second open end.

The contact plates 314 are secured within the housing 16 in a press-fit operation in which the stack 312 as a whole is pressed into the housing 316 through the second open end 60. The resulting interference fit between the stack 312 and the housing 16 secures the contact plates 314 within the housing 316, but permits pivoting motion of the contact plates 314. The first receiving groove 342 formed by the contact plates 234 is aligned with the major slot 366 of the housing 316, while the second receiving groove formed by the contact plates 234 is aligned with the minor slot 368 of the housing 316.

The connector blade 294 of the IDT 290 may, at least partially, be disposed in the first receiving groove 342 so as to be in electrical contact with the contact plates 314. The connector blade 294 may be oriented such that a longitudinal edge of the connector blade 294 extends through the first receiving groove 342 and the major slot 366 of the housing 316. Alternately, the connector blade 294 may be oriented such that the free end 296 of the connector blade 294 is received in the first receiving groove 342, with the longitudinal axis of the connector blade 294 being disposed perpendicular to the first receiving groove 342.

Figure 25:
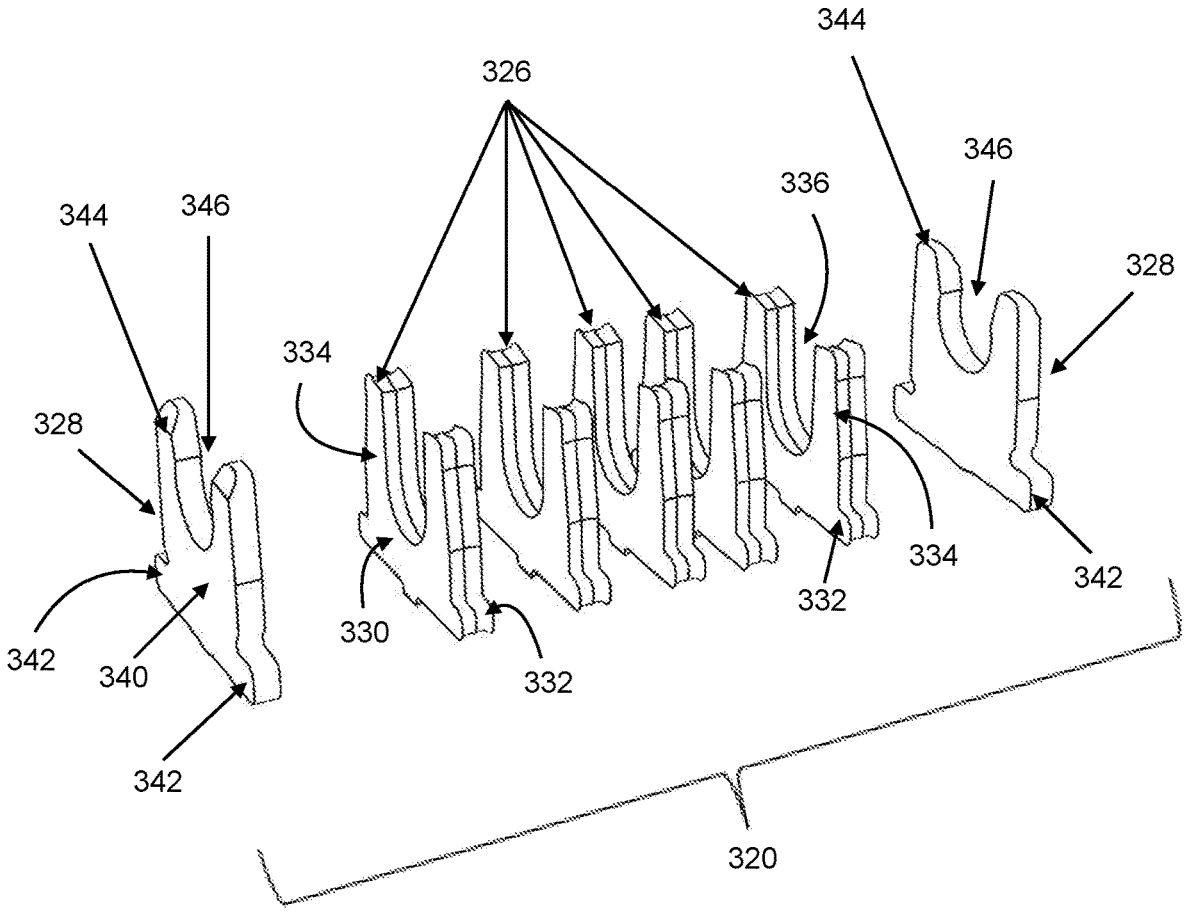
FIG. 25 shows an exploded view of an IDT constructed in accordance with an eighth embodiment.
Figure 26:
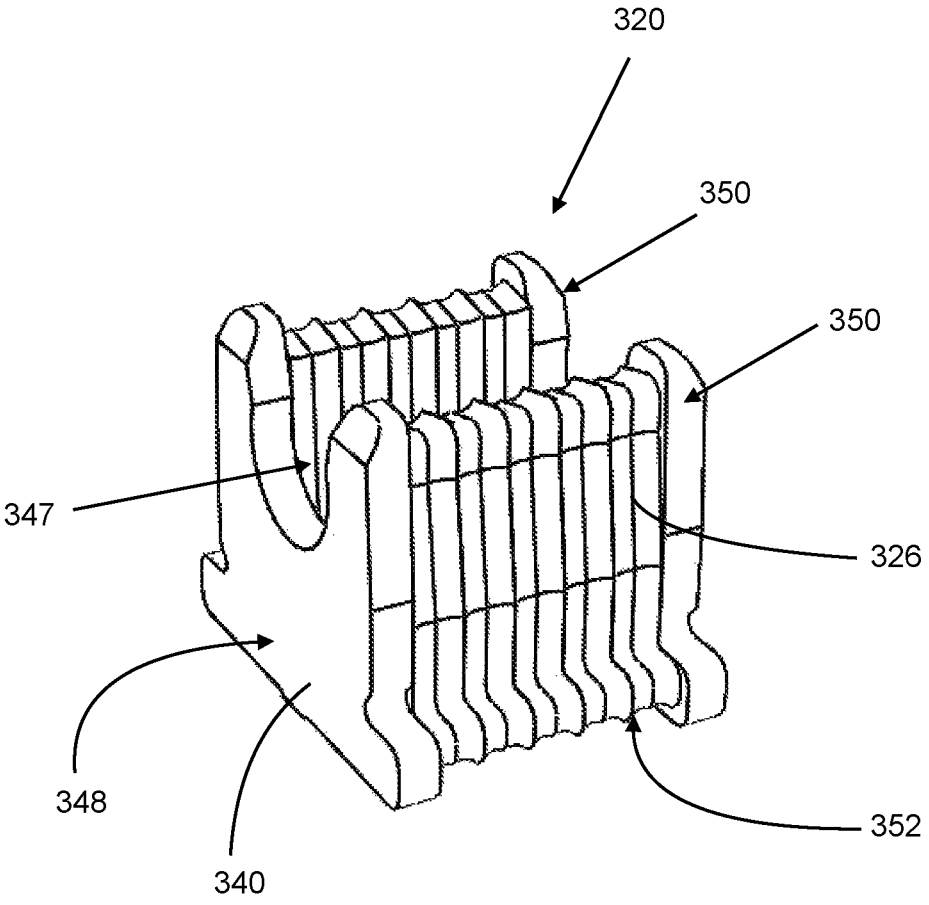
FIG. 26 shows a side perspective view of the IDT of FIG. 25.

Referring now to FIGS. 25-26, there is shown an IDT 320 for connecting a larger gauge wire 322, such as a magnet wire, to a bus bar 324 (shown in FIGS. 31-33) composed of a conductive metal, such as copper or a copper alloy. The wire 322 may have a diameter of 10 gauge or greater. The IDT 320 has a plurality of cutter plates 326 disposed between a pair of outer, holding plates 328. The plates 326, 328 are arranged in a stack in which they may directly contact each other or be separated by a thin dielectric layer. Each plate 326, 328 has a monolithic unitary structure and is composed of electrically conductive metal, such as a copper alloy, which may or may not be plated with tin. The plates 326, 328 may, by way of non-limiting example, be formed by stamping.

Figure 27:
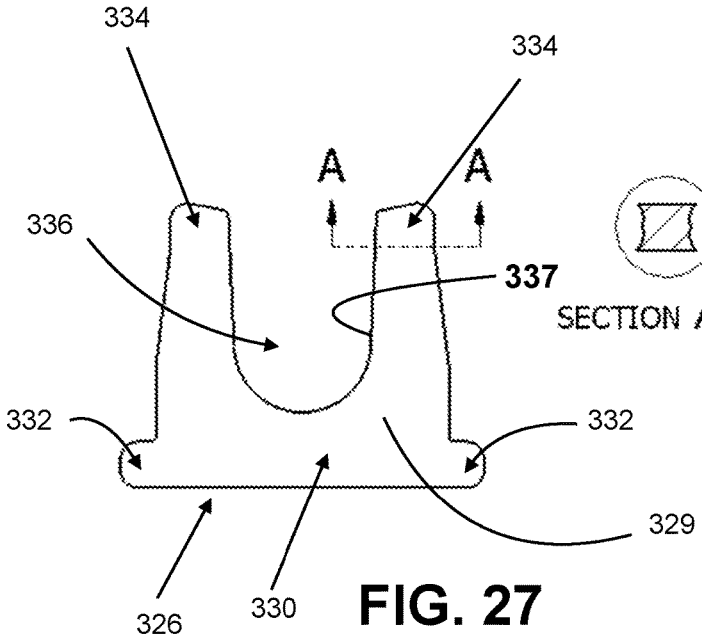
FIG. 27 shows a front elevational view of a cutter plate of the IDT of FIG. 25.
Figure 28:
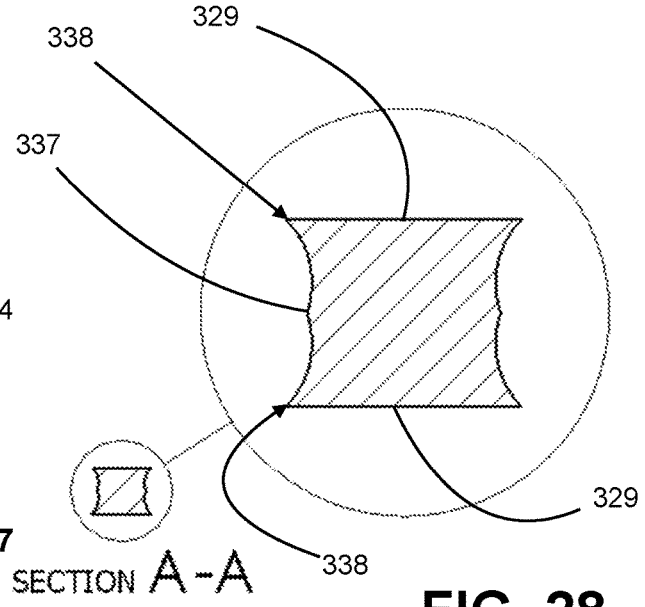
FIG. 28 shows a sectional view of the cutter plate taken along line A-A of FIG. 27.

Referring now also to FIGS. 27-28, each cutter plate 326 has opposing planar surfaces 329 and includes a base 330 having a lower portion with outwardly-extending, opposing flanges 332. A pair of engagement legs 334 extend upwardly from the base 330 and are separated by a slot 336 defined by inner surfaces 337 of the engagement legs 334 and an inner surface of a rounded, closed end. The slot 336 is formed using chemical etching, which forms sharp edges 338 at the junctures between the inner surfaces 337 of the legs 334 and the planar surfaces 329. In this manner, the inner surfaces 337 are generally concave in the direction between the surfaces 329, as shown in FIG. 28. The sharp edges 338 in each engagement leg 334 extend longitudinally along substantially the entire length of the engagement leg 334. As will be described more fully below, the sharp edges 338 are operable to pierce an insulative coating on the wire 322. The legs 334 have some elasticity so as to permit outward deflection.

The holding plates 328 have a construction generally similar to the cutter plates 326. Each holding plate 328 includes a base 340 having a lower portion with outwardly-extending, opposing flanges 342. A pair of legs 344 extend upwardly from the base 340 and are separated by a slot 346 defined by inner surfaces of the legs 344 and a rounded, closed end. Unlike the cutter plates 326, however, the inner surfaces of the legs 344 do not have any sharp edges for removing the insulative coating from the wire 322.

Figure 29:
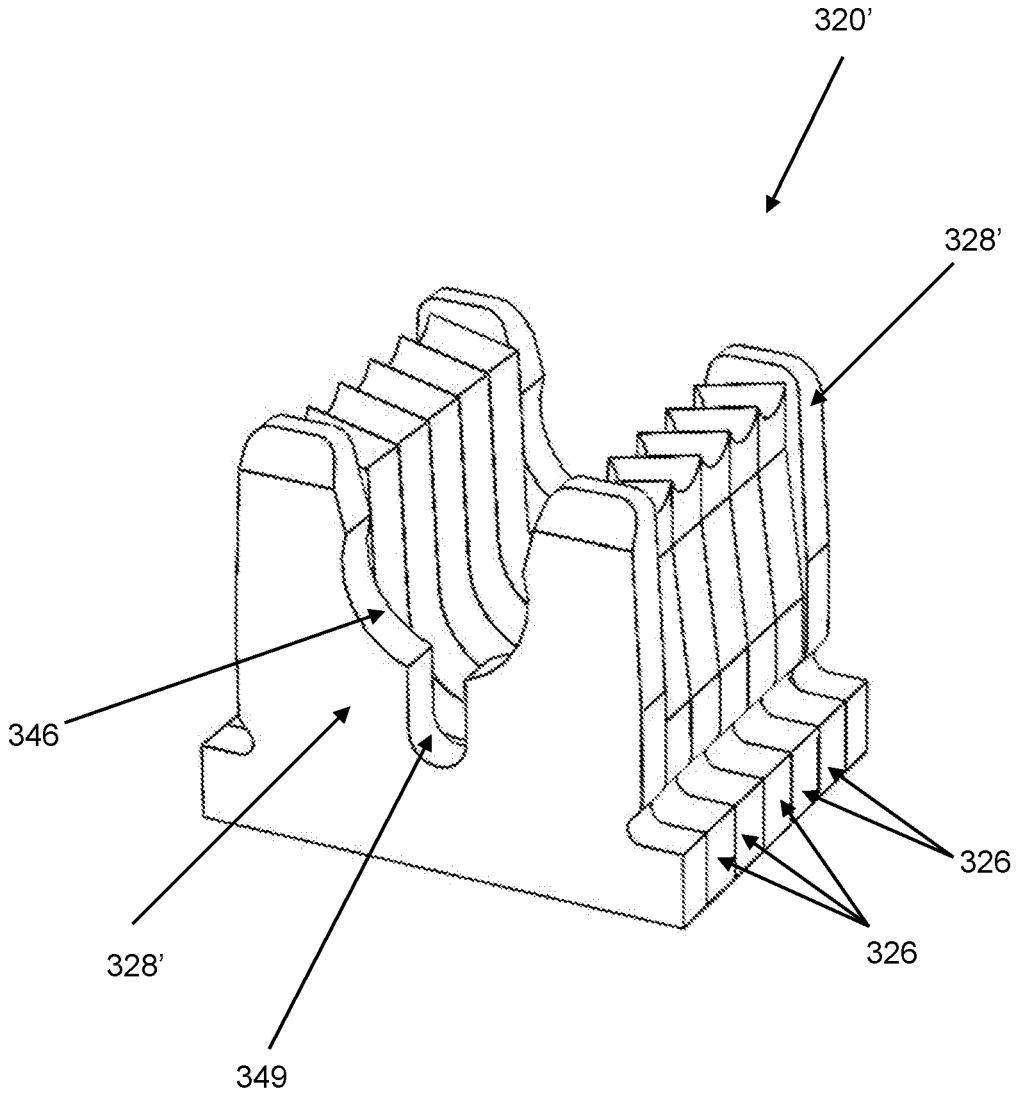
FIG. 29 shows a variation of the IDT shown in FIGS. 25 and 26.

The holding plates 328 have a more rigid construction than the cutter plates 326. In particular, the the holding plates 328 are more rigid than the cutter plates 326 in a lateral direction, i.e., in a direction normal to the direction of passage 347 formed by the cutter plates 326 and the holding plates 328 (described below). However, in an IDT 320' constructed in accordance with another embodiment shown in FIG. 29, holding plates 328' may be provided with notches 349 that adjoin and extend downwardly from the slots 346, respectively. The notches 349 give the holding plates 328' some elasticity so as to be able to slightly deflect in the lateral direction when a wire is being disposed in the IDT 320'.

The cutter plates 326 and the holding plates 328 are arranged in the stack so as to provide the IDT 320 with a base 348 (which is formed by the bases 330, 340 of the cutter plates 326 and the holding plates 328) and a pair of legs 350 (which are formed by the engagement legs 334 of the cutter plates 326 and the legs 344 of the holding plates 328). The base 348 has outwardly-extending, opposing flanges 352 formed by the flanges 332, 342 of the cutter plates 326 and the holding plates 328. The legs 350 of the IDT 320 are separated by the passage 347 that is formed by the slots 336 in the cutter plates 326 and the slots 346 in the holding plates 328. Inside the passage 347, the inner surfaces 337 of the legs 334 of the cutter plates 326 adjoin each other so as to provide each leg 350 of the IDT 320 with a laminated, jagged inner surface 353, with the sharp edges 338 forming a series of parallel sharp ridges arranged in the stacking direction of the cutter plates 326.

The cutter plates 326 and the holding plates 328 are secured together in the stack by mechanical means and/or welding. The plates 326, 328 may be mechanically held together by a bracket or a band in a press-fit manner. For example, a metal band may be tightly disposed around the IDT 320, just above the base 348, or the IDT 320 may be secured together (with or without welding) by a bracket. The plates 326, 328 may be welded together by electron beam welding or laser beam welding. Welds are made on opposing sides of the base 348. The legs 350 may be free from welds to permit independent movement of the engagement legs 334 of the cutter plates 326.

Figure 30:
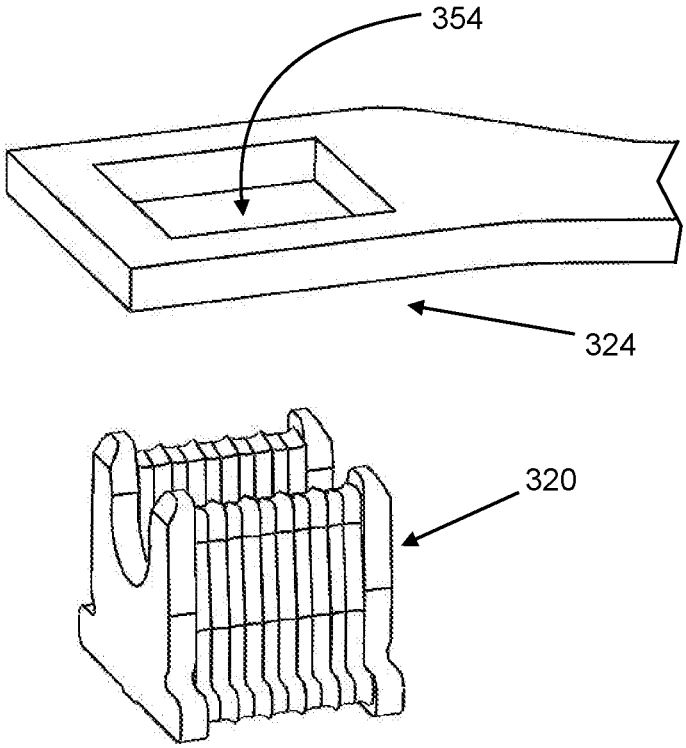
FIG. 30 shows the IDT of FIG. 25 being moved into engagement with a busbar having an opening.
Figure 31:
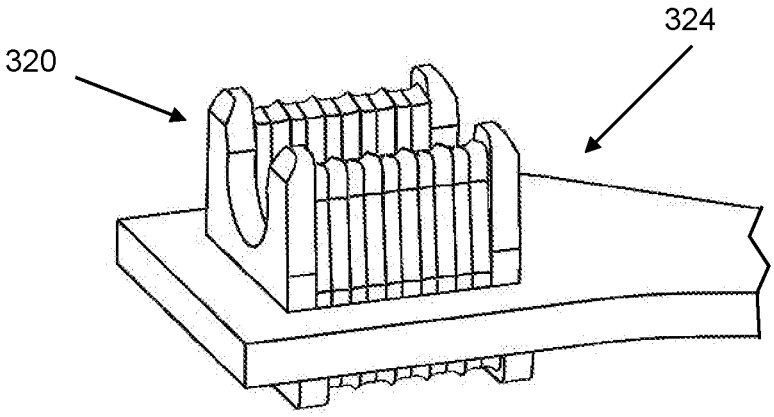
FIG. 31 shows the IDT of FIG. 25 mounted in the opening of the busbar of FIG. 30.

Referring now to FIGS. 30-31, the busbar 324 has a rectangular opening 354 configured to snugly receive the IDT 320 when the IDT 320 is pressed into the opening 354 from a bottom side of the busbar 324. With the IDT 320 so positioned in the opening 354, the flanges 352 of the IDT 320 are located on the bottom side of the busbar 324, while the legs 344 and the passage 347 are located on the top side of the busbar 324. Top surfaces of the flanges 352 abut a bottom surface of the busbar 324, around the opening 354. The base 348 of the IDT 320 is secured to the busbar 324 around the opening 354 by electron beam welding or laser beam welding.

Figure 32:
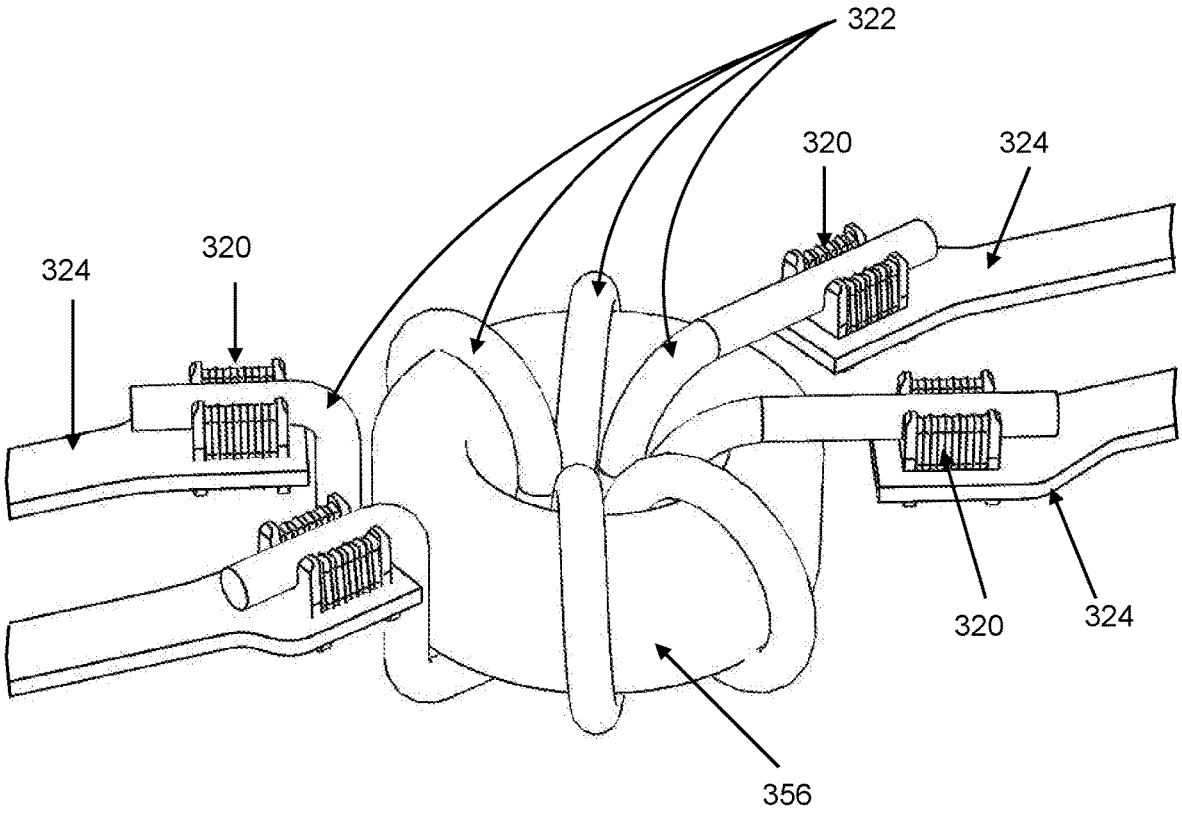
FIG. 32 shows a plurality of the IDTs of FIG. 27 connecting wires from a magnet to a plurality of busbars of FIG. 31, respectively.
Figure 33:
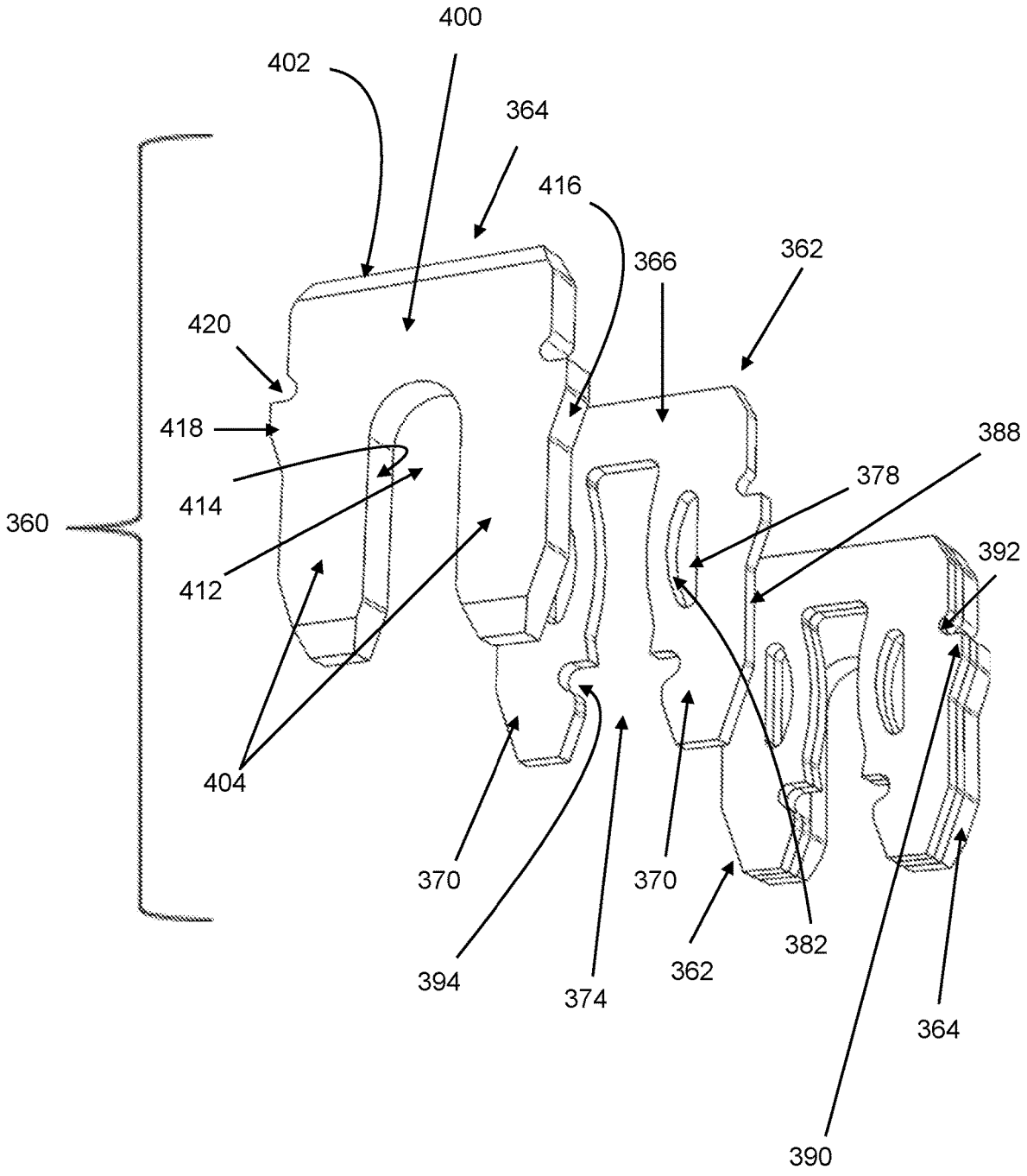
FIG. 33 shows a partially exploded view of an IDT constructed in accordance with a ninth embodiment.
Figure 34:
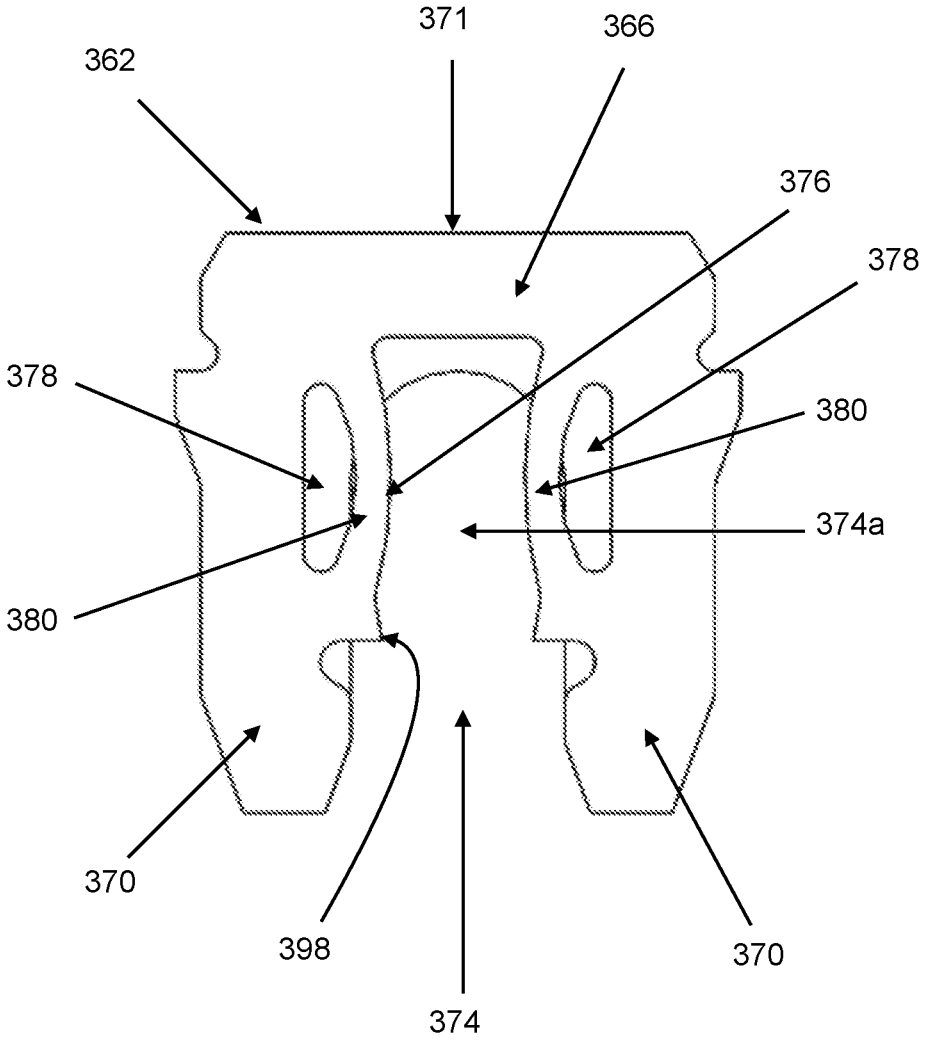
FIG. 34 shows a front view of the IDT shown in FIG. 33, with a front holding plate removed.

Referring now to FIG. 32, there is shown a plurality of magnet wires 322 wound around a magnet core 356. End portions of the wires 322 are secured to busbars 324 by IDTs 320, respectively. The end portion of each wire 322 is pressed into the passage 347 of its respective IDT 320, which causes the jagged inner surfaces 353 of the legs 350 to strip off any insulative coating on the wire 322, thereby making a good electrical connection between the wire 322 and the IDT 320. In each IDT 320, the elasticity of the legs 334 of the cutter plates 326 maintain a high normal force on the wire 322 in the event of wire creep. The welded construction of the IDT 320, together with the holding plates 328, provide the IDT 320 with structural rigidity that resists motion of the wire 322.

Referring now to FIGS. 33-38, there is shown an IDT 360 having a low profile. The IDT 360 has a plurality of cutter plates 362 secured between a pair of outer, holding plates 364. The plates 362, 364 are arranged in a stack in which they may directly contact each other or be separated by thin dielectric layers. Each plate 362, 364 has a monolithic unitary structure and is composed of electrically conductive metal, such as a copper alloy, which may or may not be plated with tin. The plates 362, 364 may, by way of non-limiting example, be formed by stamping.

Each cutter plate 362 includes a base 366 having a pair of engagement legs 370 extending in a first direction therefrom. A top edge surface 371 of the base 366 extends uninterrupted between opposing sides of the cutter plate 362. In some embodiments, however, one or more contact projections (not shown) may extend from the top edge surface 371 of the base 366 in a second direction, which is opposite the first direction. In these embodiments, each contact projection is adapted for making an electrical connection with an electrical/electronic device (such as a PCB) and may, by way of non-limiting example, be a press-fit contact projection 34, such as is shown in FIGS. 1-3, 5, and 9). Alternately, the contact projection may be a pin for soldering in a hole of a PCB, or a weld tab 36, as shown in FIG. 4, or may have some other type of construction, such as the contact projection 192 shown in FIG. 13 or the contact projection 232 shown in FIG. 19. If one or more of the cutter plates 362 of the IDT 360 is provided with a contact projection, the number and arrangement of the contact projection(s) may be as described above with regard to the IDT 12.

Each engagement leg 370 of a cutter plate 362 has an upper portion joined to the base 366 and a lower portion forming a free end. The engagement legs 370 are spaced-apart to form a slot 374 therebetween. The slot 374 has a closed end, located toward the base 366, and an open end, located at the free ends. The slot 374 is defined by opposing inner side surfaces 376 of the engagement legs 370, respectively, and has a holding portion 374*a*. Upper portions of the inner side surfaces 376 have a slight convex curvature such that the holding portion 374*a* is most narrow at a point about midway along the length of the holding portion 374*a*.

Each engagement leg 370 has an opening 378 extending therethrough, which helps form a flexible portion 380 in each engagement leg 370. The opening 378 is generally elliptical and is defined by a continuous interior surface 382 of the engagement leg 370. A portion of the interior surface 382 located toward the slot 374 is concave and has a center of curvature that corresponds to the narrowest portion of the holding portion 374*a*. The concave portion of the interior surface 382 and the convex portion of the inner side surface 376 help define the flexible portion 380 and provide it with an inwardly-bowed configuration.

The configuration of the flexible portions 380 makes them elastic, but with a high degree stiffness, which enables the flexible portions 380 to store enough force to maintain an acceptable contact force on the conductor of a wire (such as the wire 16) disposed in the holding portion 374*a*, even when the cross-section of the conductor of the wire 16 decreases due to mechanical creep. As such the flexible portions 380 function as springs to generate a high normal force connection to the conductor of the wire 16.

Each engagement leg 370 has an irregular outer side surface 388 with a lower portion that slopes inwardly toward the free end. Toward the base 366, the outer side surface 388 projects outwardly and then inwardly to form a barb 390. An outside notch 392 is formed proximate to the barb 390.

Inside notches 394 are formed in the engagement legs 370, toward the free ends, respectively. The inside notches 394 are arcuate and are defined by curved portions of the inner side surfaces 376, respectively, which adjoin the convex portions of the inner side surfaces 376 at sharp corner edges 398, respectively. The sharp edges 398 extend in the direction of the thickness of the cutter plate 362 and function as scrapers and/or cutters for piercing the insulation layer of a wire (such as the wire 16) and are hereinafter referred to as cutters 398. Below the inside notches 394, the inner side surfaces 376 slope outwardly to the free ends, respectively.

The holding plates 364 have a construction generally similar to the cutter plates 370. Unlike the cutter plates 370, however, the holding plates 364 do not have any cutters or scrapers for removing the insulation layer from the wire 16. In addition, the holding plates 364 are typically thicker than the cutter plates 370. The holding plates 364 each have a monolithic unitary structure and are composed of electrically conductive metal, such as a copper alloy, which may or may not be plated with tin. The holding plates 364 may, by way of non-limiting example, be formed by stamping. Each holding plate 364 includes a base 400 having a smooth, planar upper edge surface 402 extending, uninterrupted, between opposing sides of the holding plate 364. A pair of legs 404 extend from the base 400 in a first (downward) direction. In some embodiments, one or more contact projections may extend from the upper edge surface 402 of the base 400 in a second direction, which is opposite the first direction.

Each leg 404 of the holding plates 364 has an upper portion joined to the base 400 and a lower portion forming a free end. The legs 404 are spaced-apart to form a slot 412 therebetween. The slot 412 has an arcuate, closed end, located toward the base 400, and an open end, located at the free ends. The legs 404 each have a smooth inner side surface 414 and an irregular outer side surface 416 with a lower portion that slopes inwardly toward the free end. Toward the base 400, the outer side surface 416 projects outwardly and then inwardly to form a barb 418. An outside notch 420 is formed proximate to the barb 418. The slot 412 is defined by the inner side surfaces 414 of the legs 404.

The cutter plates 362 and the holding plates 364 are secured together in a stack by mechanical means and/or welding to provide the IDT 360 with a base 420 (which is formed by the bases 366, 400 of the cutter plates 362 and the holding plates 364) and a pair of legs 424 (which are formed by the engagement legs 370 of the cutter plates 362 and the legs 404 of the holding plates 364). The cutter plates 362 and the holding plates 364 may be secured together by a band or welded together in the manner described above with regard to IDT 12. Each leg 404 has an outer boundary delimited by the outer side surfaces 388, 416 of the cutter plates 362 and the holding plates 364, respectively, and and an inner boundary delimited by the inner side surfaces 376, 414 of the cutter plates 362 and the holding plates 364, respectively.

The legs 424 of the IDT 360 are separated by a passage 430 that is formed by the slots 374 in the cutter plates 362 and the slots 412 in the holding plates 364. The holding portions 374*a* of the cutter plates 362 are aligned with each other to form a holding portion 430*a* of the passage 430, which is disposed inward from the upper portions of the inner side surfaces 376 of each of the holding plates 364. The cutters 398 in each of the legs 404 are aligned to form a laminated cutting edge 434 disposed in the passage 430.

On the outer side of each leg 424, the barbs 390, 418 of the cutter plates 362 and the holding plates 364, respectively, are aligned and form a laminated barb 435 having a top ledge 436. The outside notches 392, 420 of the cutter plates 362 and the holding plates 364, respectively, are also aligned and form a groove 438 that adjoins the top ledge 436 of the barb 435. The cutter plates 362 and the holding plates 364 may be mechanically secured together by a metal band that is tightly disposed around the stack, just below the ledges 436. Alternately, the cutter plates 362 and the holding plates 364 may be mechanically secured together by the bracket 446 described below.

The IDT 360 is shorter (has a lower profile) than the IDT 12 for a particular application because of the construction of the engagement legs 370 of the cutter plates 362. In particular, the flexible portion 380 of an engagement leg 370 provides the same normal force to a wire conductor as the entire engagement leg 32 of a cutter plate 20 of the IDT 12. As such, the engagement legs 370 of the IDT 360 can be made shorter than the engagement legs 32 of the IDT 12.

Figure 35:
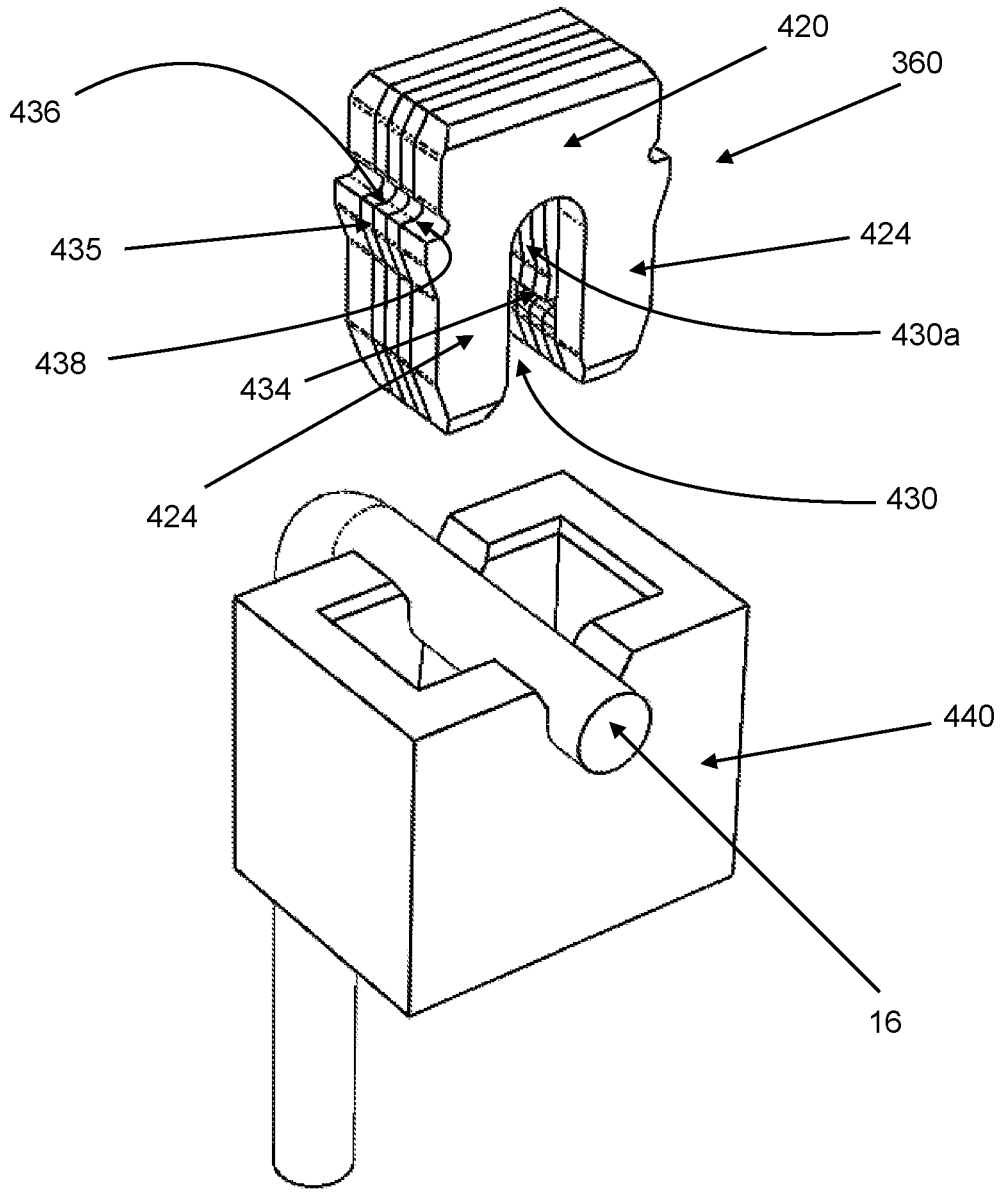
FIG. 35 shows a perspective view of the IDT of FIG. 33 disposed above a housing holding a wire.
Figure 36:
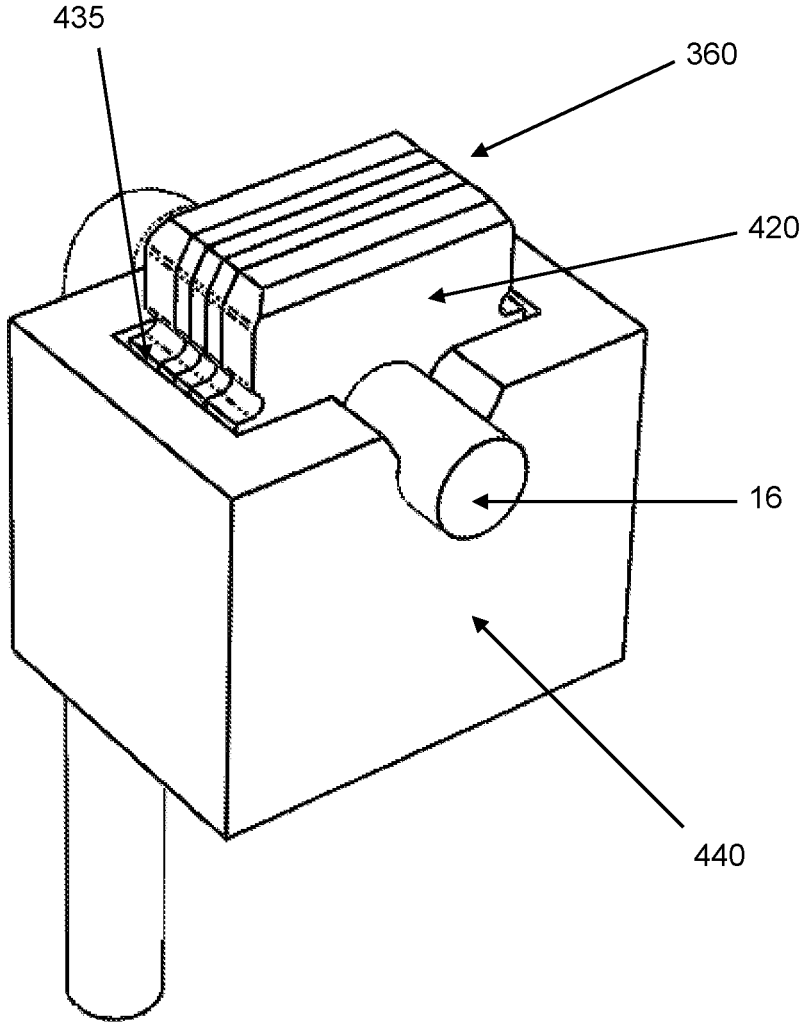
FIG. 36 shows a perspective view of the IDT of FIGS. 33 and 35 mounted to the housing of FIG. 35.

With particular reference now to FIGS. 35 and 36, the IDT 360 may be used with a housing 440. The housing 440 has the same construction as the housing 14 of the IDC 10, except the housing 440 is shorter, i.e., has a lower profile, than the housing 14 to accommodate the lower profile of the IDT 360. The IDT 360 and the housing 440 may be engaged with each other in substantially the same manner as the IDT 12 and the housing 14 to make an electrical connection between a wire (such as the wire 16) and the IDT 360. One difference is that the laminated barbs 435 exert forces against the interior side surfaces of the housing 440 to retain the IDT 360 in the pocket of the housing 440. In contrast, the barbs 92 of the holding plates 24 of the IDT 12 engage the interior side surfaces of the housing 14 to retain the IDT 12 in the housing 14.

Figure 37:
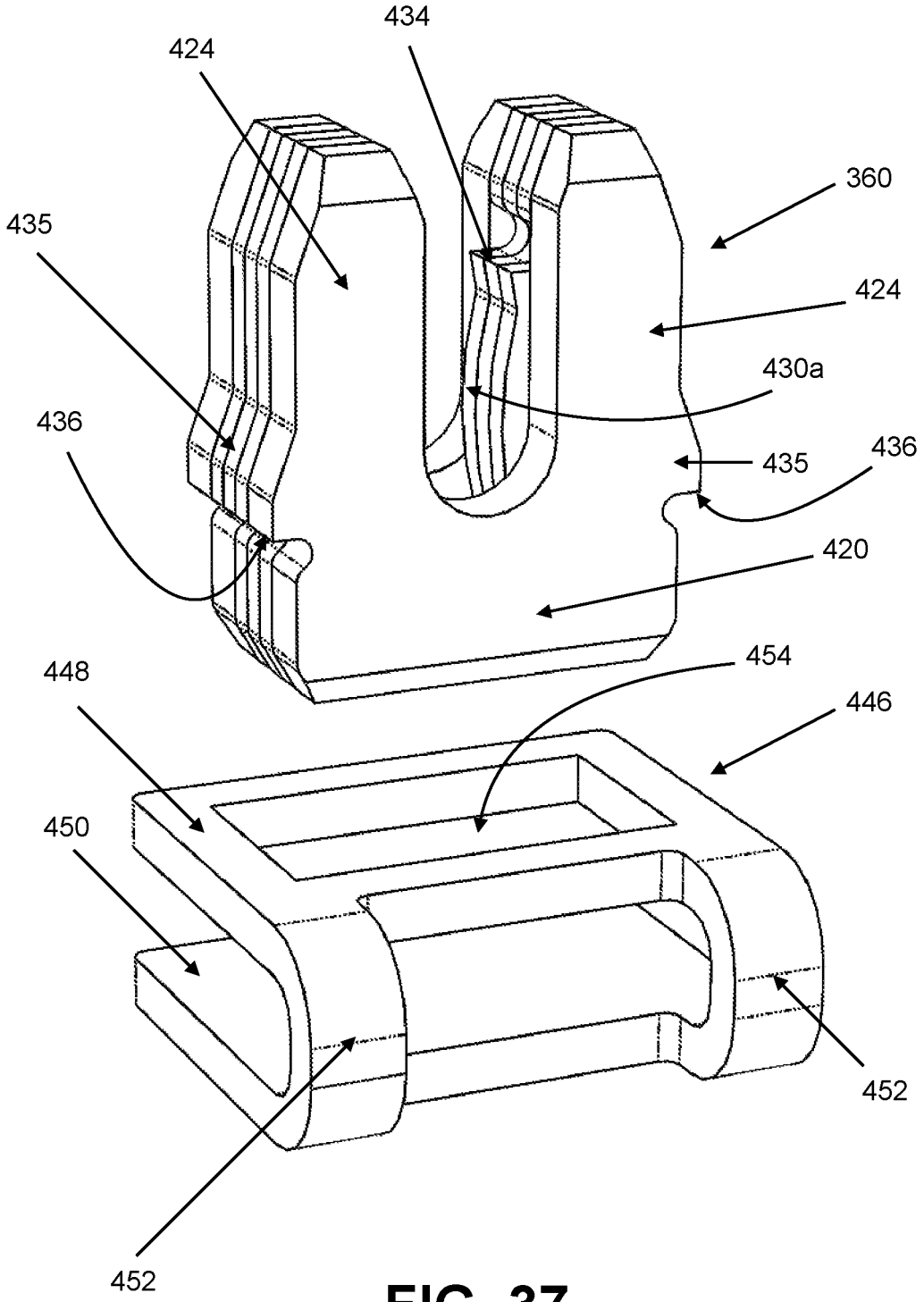
FIG. 37 shows a perspective view of the IDT of FIGS. 33 and 35 disposed above a mounting bracket.
Figure 38:
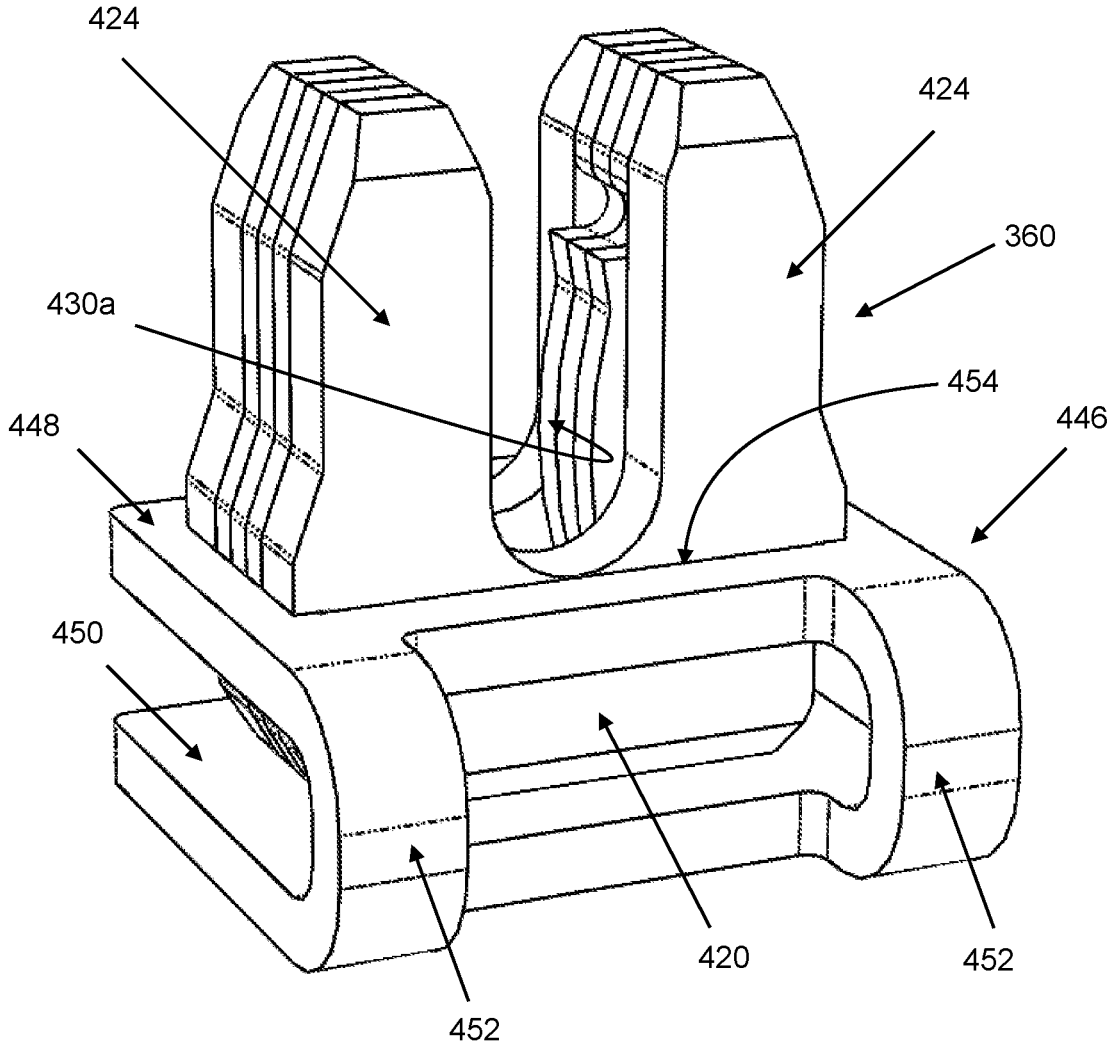
FIG. 38 shows the IDT mounted to the mounting bracket of FIG. 37 to form an CC.

With particular reference now to FIGS. 37 and 38, there is shown a mounting bracket 446 that may be used to mount the IDT 360 to a pad of an electrical/electronic device, such as a printed circuit board or a metal core printed circuit board. The bracket 446 generally has the configuration of a C-shaped clip and is formed from an electrically conductive metal, such as a copper alloy, which may or may not be plated with tin. The bracket 446 includes a frame 448 connected to a mounting plate 450 by a pair of bends 452 such that the frame 448 is disposed parallel to, but spaced from, the mounting plate 450. The frame 448 includes an enlarged opening 454 that is configured to snugly receive the base 420 of the IDT 360. To mount the IDT 360 to the bracket 446, the base 420 is inserted into the opening 454 until the top ledges 436 of the barbs 435 contact portions of the frame 448 disposed adjacent to the opening 454. In this manner, the frame 448 holds and supports the IDT 360 in position relative to the rest of the bracket 446. With the IDT 360 so mounted, the IDT 360 is physically and electrically connected to the bracket 446.

The IDT 360 in combination with the bracket 446 and/or the housing 440 may form an IDC that is operable to electrically connect an insulated wire, such as the wire 16, to an electrical/electronic device, such as a PCB. As can be readily appreciated, the bracket 446 is not used in those embodiments where the IDT 360 has one or more contact projections adapted for making an electrical connection with an electrical/electronic device. FIGS. 39-43 show some of the applications in which the IDT 360 may be used.

Figure 39:
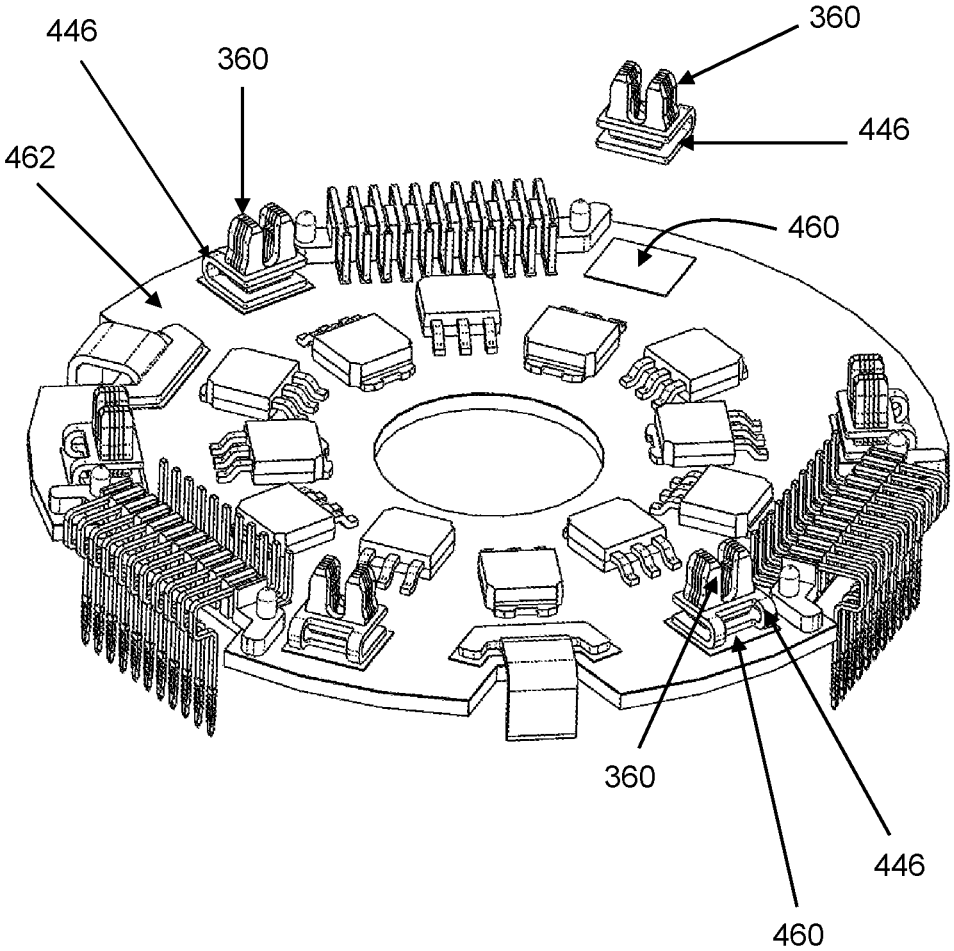
FIG. 39 shows a perspective view of a plurality of the IDCs of FIG. 38 mounted to an electrical/electronic device.

FIG. 39 shows a plurality of IDTs 360 mounted to brackets 446, respectively. A plurality of the brackets 446 (with IDTs 360) are secured to metal pads 460 of an electrical/electronic device 462, which may be a PCB or a metal core printed circuit board having electronic components mounted thereto. The brackets 446 are secured to the pads 460 by soldering or sintering the outer sides of the mounting plates 450 of the brackets 446 to the pads 460, respectively. The IDTs 360 mounted to the brackets 446 secured to the metal pads 460 are physically and electrically connected to the device 462.

Figure 40:
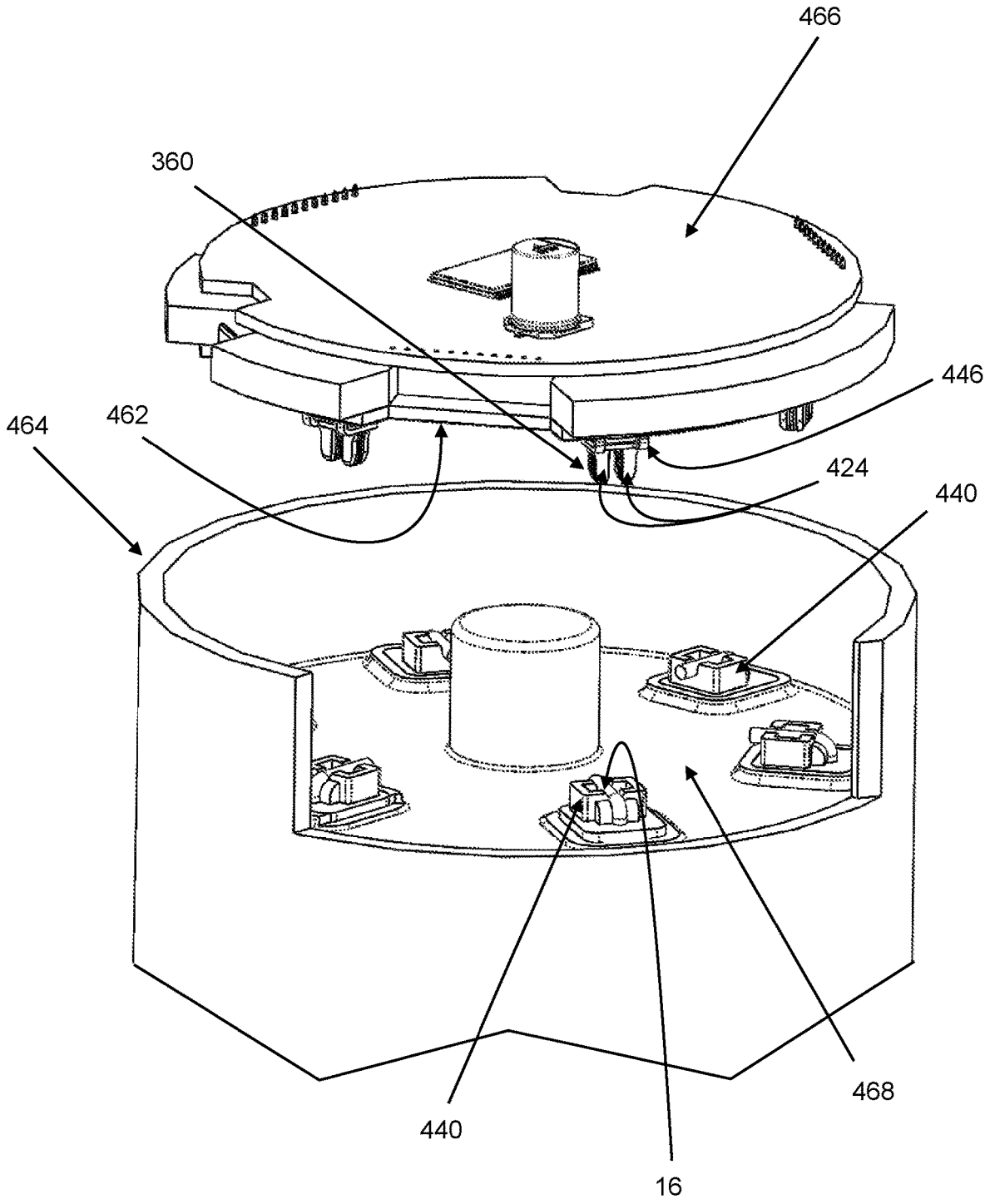
FIG. 40 shows a partially exploded view of an electric machine having the electrical/electronic device of FIG. 39 mounted to an end cap of the machine.

As shown in FIG. 40, the device 462 may be a component of a larger device or machine 464, such as an electric motor. The device 462 is mounted to the underside of an end piece 466 of the machine 464. The legs 424 of the IDTs 360 extend downwardly from the device 462 and are securely received within housings 440, which are secured to another component 468 (such as a PCB) of the machine 464. The housings 440, in turn, hold wires (such as the wires 16). With the IDTs 360 so connected to the housings 440, the IDTs 360 (and, thus, the device 462) are electrically connected to the wires 16 (and, thus, the component 468). In this particular application, a plurality of IDCs are formed, with each IDC comprising an IDT 360, a bracket 446 and a housing 440.

Figure 41:
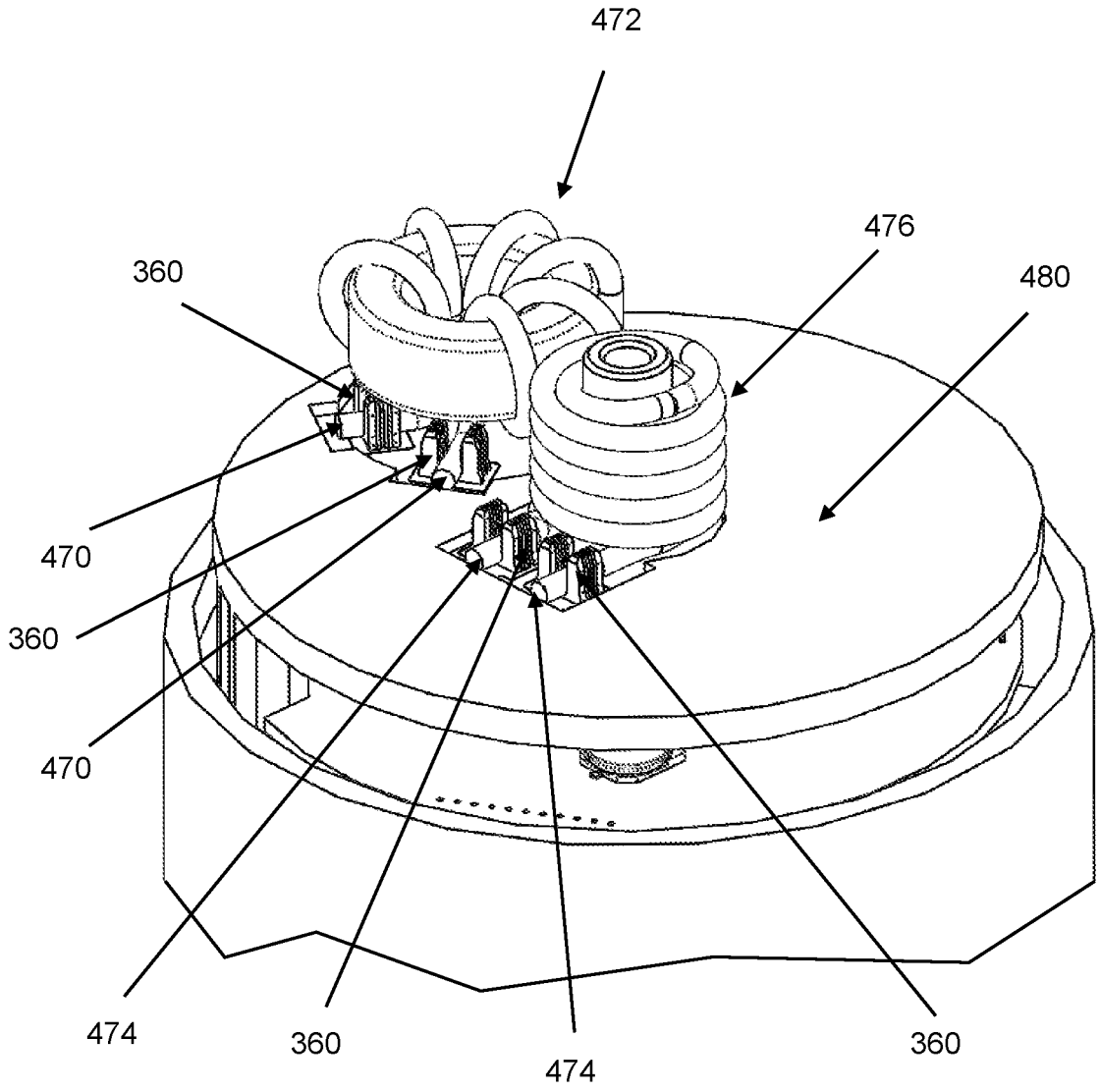
FIG. 41 shows a perspective view of a portion of a machine having a plurality of the IDCs of FIG. 38 connected to coil wires of electrical devices.

Referring now to FIG. 41, a first pair of IDTs 360 mounted in brackets 446, respectively, are electrically connected to wires 470 of a first electrical device 472, such as a magnetic coil, and a second pair of IDTs 360 mounted in brackets 446, respectively, are electrically connected to wires 474 of a second electrical device 476, such as a coil, which may also be magnetic. The first and second pairs of IDTs 360 and brackets 446 extend through openings in a substrate 480, such as that of a PCB, which may, at least partially, support the electrical devices 472, 476. The brackets 446 may be electrically and physically connected to a structure of the substrate 480 or to a structure disposed below the substrate 480. In this particular application, a plurality of IDCs are formed, with each IDC comprising an IDT 360 and a bracket 446.

Figure 42:
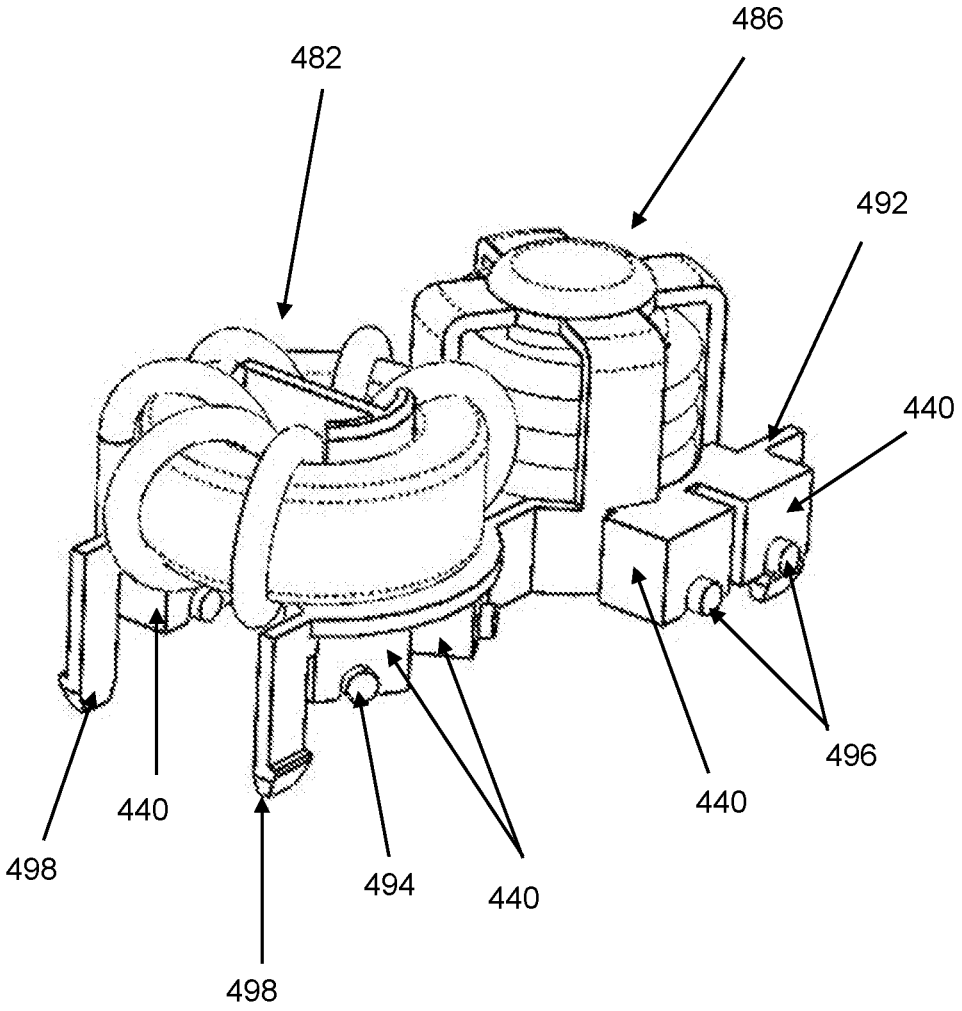
FIG. 42 shows a perspective view of electrical devices mounted to a support housing that includes a plurality of IDTs of FIGS. 33 and 35.

Referring now to FIG. 42, electrical devices 482, 486 are shown mounted to a support housing 492. The support housing 492 is composed of plastic and supports coils of the electrical devices 482, 486. The support housing 492 includes a plurality of the housings 440 within which IDTs 360 are mounted to form a plurality of IDCs. The housings 440 may be integrally joined together, e.g., are molded into the support housing 482 to form a monolithic structure. The IDCs hold wires 494, 496 of the electrical devices 482, 486. A plurality of the housings 440 are integrally joined to snap-fit projections 498 for securing the support housing 492 to a substrate, such as a PCB in a snap-fit manner. It should be appreciated that in other embodiments, a pair of support housings may be provided, one for each of the electrical devices 482, 486. Still further, the support housing 492 may including a plurality of sections that are not integrally joined together, but are interconnected.

The IDT 360 is described above as being used with the housing 440 or the bracket 446 to electrically connect an insulated wire to an electrical/electronic device, such as a PCB. It should be appreciated, however, that the IDT 360 by itself may be used to electrically connect a wire to an electrical/electronic device. For example, a top surface of the IDT 360 formed from the top edge surfaces 371 of the cutter plates 362 and the upper edge surfaces 402 of the holding plates 364 may be directly secured (such as by soldering or sintering) to a metal pad of a PCB. Alternately, the IDT 360 may be modified to include a metal plate that is secured (such as by welding) directly to the top edge surfaces 371 of the cutter plates 362 and the upper edge surfaces 402 of the holding plates 364. This metal plate would then be secured to the metal pad of the PCB through soldering or sintering. In these examples, the IDT 360 alone would form an IDC.

Figure 43:
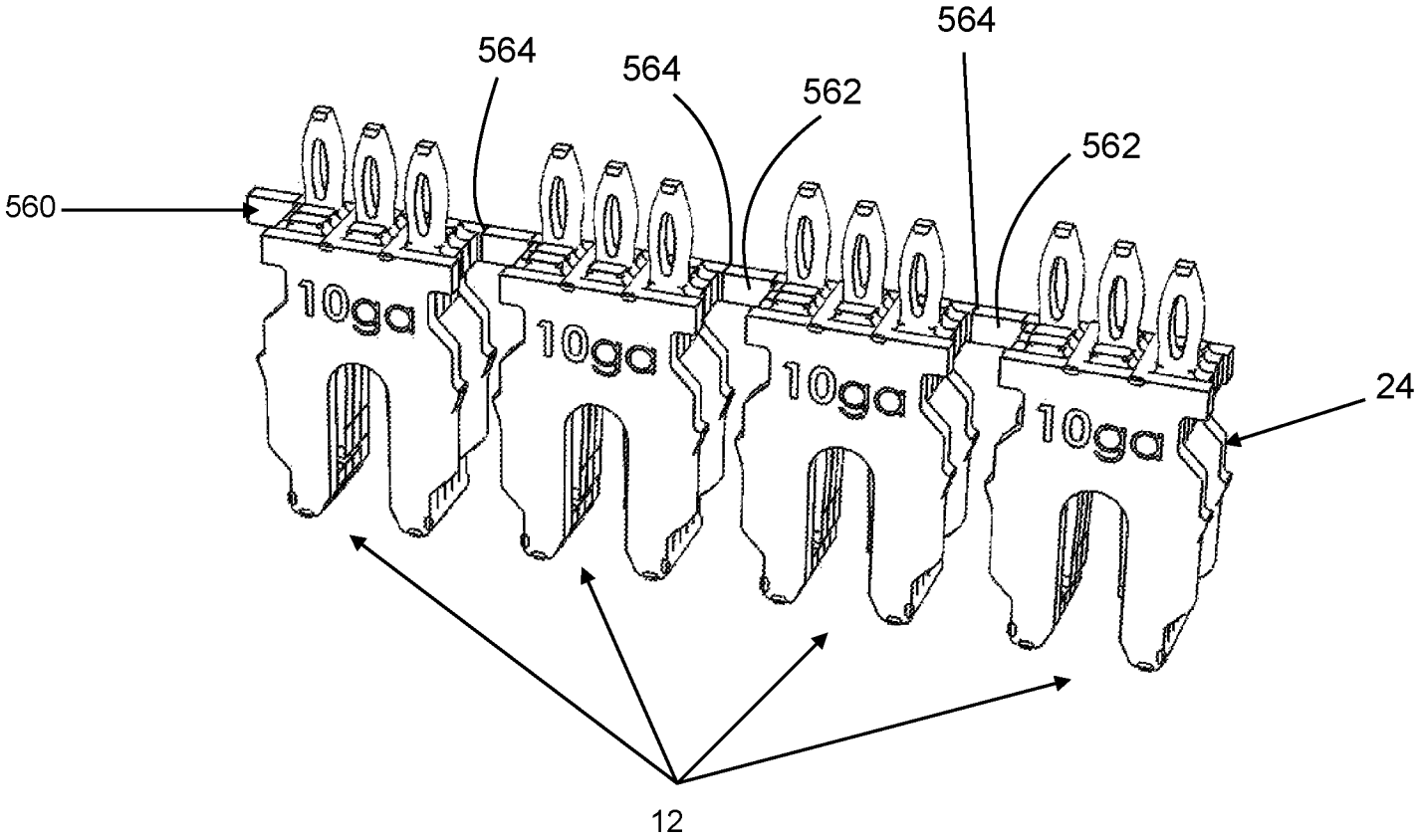
FIG. 43 shows a plurality of the IDTs of FIGS. 1-3 formed on a strip of metal.
Figure 44:
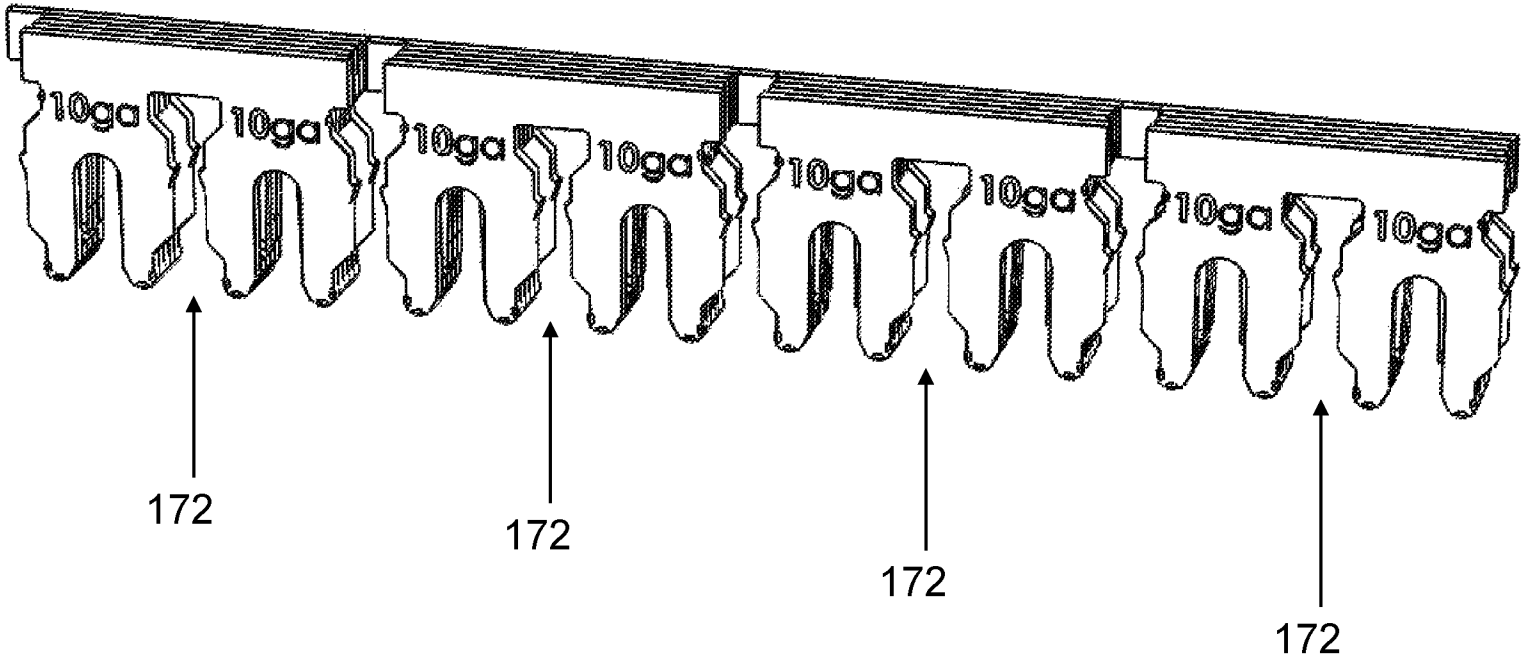
FIG. 44 shows a plurality of the IDTs of FIG. 12 formed on a strip of metal.

The IDTs of the present disclosure may be produced in a roll-to-roll assembly process, wherein a plurality of the IDTs are formed on a continuous strip of metal that also forms part of the IDTs. FIG. 43 shows a plurality of IDTs 12 that have been so formed and FIG. 44 shows a plurality of IDTs 172 that have been so formed. For purposes of brevity, the process will only be described with regard to the IDT 12, it being understood that the process is essentially the same for each different type of IDT.

The process uses a continuous strip 560 of metal (such as a copper alloy) that is stamped to form a plurality of bottom holding plates 24 that are connected together by spacers 562 joined between the shoulders 78 of the holding plates 24. The strip 560 has notches or scores 564 formed therein at the junctures between the spacers 562 and the shoulders 78 to facilitate the separation of the formed IDTs 12. Cutter plates 20 and a top holding plate 24 are stacked on top of each holding plate 24 of the strip 560 and are then secured together to form an IDT 12. The strip 560 may be fully stamped to form all of the bottom holding plates 24 before the cutter plates 20 and the top holding plates 24 are stacked and secured on the strip 560, or the strip 560 may be stamped as the cutter plates 20 and the top holding plates 24 are stacked and secured to the strip 560. The stacking and securing of the cutter plates 20 and the top holding plate 24 to form an IDT 12 may be performed at a single station, with the strip 560 moving into and out of the station to form an IDT 12 on the strip 560. If the strip is not fully stamped ahead of time, the strip 560 may be stamped to form the bottom holding plate 24 at the same station or at another, previous station. Alternately, the stacking and securing of the plates 20, 24 may be performed at a plurality of stations, with the strip 560 being moved from station to station to form an IDT 12. If the strip 560 is not fully stamped ahead of time, the strip 560 may be stamped to form the bottom holding plate 24 at an initial station before the strip moves to the other stations. In one example, there may be six stations, one for the stamping to form the bottom holding plate 24, one for placement of each cutter plate 20, one for placement of the top holding plate 24 and one for securing the plates together.

The process of forming the IDTs 12 described above may further include the step of separating the IDTs 12 at the scores to form a plurality of separate IDTs 12, which are then packaged for shipment and/or sale. Alternately, the IDTs 12 may be kept together on the strip 560 and packaged for shipment and/or sale as a strip of interconnected IDTs 12.

While each of the IDTs and IDCs described above is described as having structure for displacing/removing insulation from a wire and being used for this function, it should be appreciated that the IDTs and IDCs described above can be used with wires that have already had insulation removed so as to expose the underlying conductor. In such an application, the exposed conductor of the wire moves into the holding portion (102*a*, 430*a*) of the passage (102, 430) in an IDT with only a small amount of scraping against the laminated cutting edges (108, 434) and is held in the holding portion (102*a*, 430*a*) by the high normal forces exerted by the resilient engagement legs (32, 370) of the cutter plates (20, 362).

It should also be appreciated that the above-described IDTs can be modified so as to be especially adapted for use with wires that have already had insulation removed. For example, the cutters (62, 398) of the cutter plates (20, 362) in an IDT may be removed and replaced with rounded edges. The curvature of the edges may be selected to provide a gradual or more abrupt transition from the entrance portion to the holding portion (102*a*, 430*a*) depending on the nature of the conductor, etc.

It is to be understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. An insulation displacement connector for making an electrical connection to at least one wire having an inner metal conductor covered with an outer insulation layer, the insulation displacement connector comprising:

a plurality of metal plates secured together to form a stack that defines a passage for receiving the wire, wherein a plurality of the plates are cutter plates having cutting edges, respectively, for disrupting the insulation layer of the wire to permit the conductor to directly contact the cutter plates, each of the cutter plates comprising a pair of legs joined to a base, each of the legs including one of the cutting edges and being spaced-apart to form a slot in-between, the cutting edges adjoining the slot on opposing sides of the slot;

wherein an outermost pair of the plates are holding plates, each holding plate comprising a pair of legs that are spaced-apart to form a slot in-between, the cutter plates being disposed between the holding plates such that the slots in the cutter plates and the holding plates are aligned to form the passage; and wherein the holding plates are more rigid than the cutter plates in a direction normal to the direction of the passage.

2. The insulation displacement connector of claim 1, wherein in each cutter plate, each leg has a hole extending therethrough that forms a spring portion that is resiliently deflectable in a direction normal to the direction of the passage.

3. The insulation displacement connector of claim 1, further comprising:

a housing having a pair of opposing side walls with slots formed therein and an interior pocket accessible through an exterior opening in the housing, the pocket being adapted to receive at least a portion of the stack and being at least partially defined by opposing interior surfaces, the slots being aligned and cooperating with the pocket to form a route extending through the housing, the route being adapted to receive the wire and being aligned with the passage in the stack when the stack is disposed in the pocket.

4. The insulation displacement connector of claim 3, wherein each of the holding plates have outer edges with barbs for engaging the interior surfaces of the housing.

5. The insulation displacement connector of claim 1, further comprising:

a bracket having a frame connected to and spaced from a mounting plate, the frame defining an opening through which at least a portion of the stack extends.

6. The insulation displacement connector of claim 5, wherein the frame is connected by one or more bends to the mounting plate, and wherein the frame is disposed parallel to the mounting plate.

7. The insulation displacement connector of claim 1, wherein at least one of the cutter plates has a contact projection for making an electrical connection.

8. The insulation displacement connector of claim 7, wherein the contact projection comprises a fastening structure that is resiliently deformable for press-fit insertion into a hole of a substrate.

9. The insulation displacement connector of claim 1, wherein the stack is for electrically connecting the wire, which is a first wire, to a second wire having an inner metal conductor covered with an outer insulation layer;

wherein the stack defines a second passage for receiving the second wire; and wherein at least one of the plates has an additional two cutting edges for disrupting the insulation layer of the second wire to permit the conductor of the second wire to directly contact the plate.

10. A combination of a plurality of the insulation displacement connectors of claim 1, wherein the insulation displacement connectors are secured together.

11. The combination of claim 10, wherein in each of the insulation displacement connectors, the holding plates are first and second holding plates and wherein the first holding plates are connected together by spacers, and wherein the first holding plates and the spacers are together a monolithic structure formed from a single metal strip, and wherein the spacers are delimited by scores that facilitate the separation of the stacks from each other, wherein the cutter plates are disposed between the holding plates; and wherein the slots in the cutter plates and the holding plates are aligned to form the passage.

12. The insulation displacement connector of claim 1, wherein the holding plates do not have any cutting edges, and wherein the holding plates and the cutter plates are monolithic structures.

13. The insulation displacement connector of claim 7, wherein a plurality of the cutter plates have contact projections, respectively, for making electrical connections.

14. The insulation displacement connector of claim 13, wherein the cutter plates and the holding plates are secured together by welding.

15. The insulation displacement connector of claim 13, wherein each of the contact projections of the cutter plates comprise a pair of tines separated by a spacing, the spacings being aligned so as to form a slot for receiving a bar.

16. The insulation displacement connector of claim 15, wherein the tines of the cutter plates are not secured together and are resiliently deflectable; and wherein the holding plates each have a body portion with a slot formed therein, the tines being disposed between the body portions of the holding plates such that the slots of the holding plates are aligned with the slot formed by the tines of the cutter plates.

17. The insulation displacement connector of claim 13, wherein the insulation displacement connector is adapted for mounting to a substrate;

wherein each of the cutter plates has a contact projection with a fastening structure that is resiliently deformable for press-fit insertion into a hole of the substrate; and wherein each of the holding plates has an upwardly-extending tongue with a tapered free end for receipt into a slot of the substrate.

18. The insulation displacement connector of claim 13, further comprising a plurality of contact plates connected to the cutter plates, respectively; and wherein each of the contact plates comprise a pair of arms separated by a spacing, the spacings being aligned so as to form a slot for receiving a bar.

19. The insulation displacement connector of claim 18, wherein the contact plates are pivotable about the contact projections of the cutter plates, respectively; and wherein the contact projections of the cutter plates have an arcuate surface to facilitate pivoting.

20. The insulation displacement connector of claim 18, wherein in each contact plate, the spacing is an upper spacing and wherein each contact plate further has a lower spacing, the arms of each contact plate being joined together in-between the upper and lower spacings;

wherein the contact plates are arranged in a stack such that the upper spacings of the contact plates form the slot, which is an upper slot, and the lower spacings of the contact plates form a lower slot; and wherein the contact projections of the cutter plates form a laminated ridge which is disposed in the lower slot formed by the contact plates, whereby the contact plates are pivotable about the laminated ridge.

21. The insulation displacement connector of claim 20, wherein the holding plates each have a body portion with a slot formed therein, the contact plates being disposed between the body portions of the holding plates such that the slots of the holding plates are aligned with the upper slot of the contact plates; and wherein the contact projections of the cutter plates prevent the contact plates from being removed in a vertical direction and the holding plates prevent the contact plates from being removed in a stacking direction, whereby the cutter plates and the holding plates pivotably hold the contact plates to thereby form a coupler.

* * * * *